US011345154B2

(12) United States Patent
Kiuchi et al.

(10) Patent No.: US 11,345,154 B2
(45) Date of Patent: May 31, 2022

(54) INKJET PRINTING APPARATUS AND RECOVERY METHOD

(71) Applicant: CANON KABUSHIKI KAISHA, Tokyo (JP)

(72) Inventors: Takahiro Kiuchi, Fuchu (JP); Noriko Sato, Kawasaki (JP); Hiroshi Nakai, Sagamihara (JP); Takashi Sasaki, Yokohama (JP); Takatoshi Nakano, Yokohama (JP); Atsushi Takahashi, Tama (JP); Takuya Fukasawa, Yokohama (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/564,512

(22) Filed: Sep. 9, 2019

(65) Prior Publication Data

US 2020/0108610 A1 Apr. 9, 2020

(30) Foreign Application Priority Data

Oct. 5, 2018 (JP) ..... JP2018-189626

(51) Int. Cl.
*B41J 2/175* (2006.01)
*B41J 2/165* (2006.01)

(52) U.S. Cl.
CPC ..... *B41J 2/16523* (2013.01); *B41J 2/16535* (2013.01)

(58) Field of Classification Search
CPC ..... B41J 2/16523; B41J 2/16532; B41J 2/16535; B41J 2/16585; B41J 2/17513
See application file for complete search history.

(56) References Cited

U.S. PATENT DOCUMENTS 6,145,956 A 11/2000 Koitabashi et al. ..... 347/30
6,984,009 B2 1/2006 Nakagawa et al.
(Continued)

FOREIGN PATENT DOCUMENTS

CN 1057428 1/1992
CN 101497270 8/2009
(Continued)

OTHER PUBLICATIONS

Office Action dated May 19, 2021 in counterpart Chinese Application No. 201910934249.2, together with English translation thereof.

*Primary Examiner* — Lam S Nguyen
(74) *Attorney, Agent, or Firm* — Venable LLP

(57) ABSTRACT

The inkjet printing apparatus includes: a printing unit to eject ink; a wiping unit capable of wiping an ejection opening surface by moving relative to the ejection opening surface with an opening, adapted to be in contact with the ejection opening surface, put in contact with the ejection opening surface; a suction unit connected to the wiping unit and configured to apply negative pressure to the ejection opening surface via the opening; a moving unit to move the wiping unit relative to the ejection opening surface; and a control unit to perform suction wiping operation by wiping the ejection opening surface with the wiping unit while applying negative pressure to the ejection opening surface. The control unit determines the timing to perform the suction wiping operation, and, according to the timing, determines a moving speed of the moving unit and a pressure value caused by the suction unit.

10 Claims, 15 Drawing Sheets

(56) References Cited

U.S. PATENT DOCUMENTS

| | | | | |
|---|---|---|---|---|
| 7,144,096 | B2 | 12/2006 | Seki et al. | |
| 7,396,095 | B2 | 7/2008 | Nakagawa et al. | |
| 7,980,659 | B2 | 7/2011 | Sekiyama | 347/33 |
| 8,485,636 | B2 * | 7/2013 | Shindo | B41J 2/16532 347/30 |
| 8,794,737 | B2 * | 8/2014 | Taira | B41J 29/38 347/23 |
| 8,827,419 | B2 | 9/2014 | Nakagawa et al. | |
| 9,096,065 | B2 | 8/2015 | Nakano et al. | |
| 9,242,470 | B2 | 1/2016 | Suzuki et al. | |
| 9,387,679 | B2 | 7/2016 | Shiiba et al. | |
| 9,517,628 | B2 | 12/2016 | Tenkawa et al. | |
| 10,286,657 | B2 | 5/2019 | Kameshima et al. | |
| 10,427,410 | B2 | 10/2019 | Nakagawa et al. | |
| 10,442,191 | B2 | 10/2019 | Takahashi et al. | |
| 10,479,088 | B2 | 11/2019 | Sasaki et al. | |
| 10,493,762 | B2 | 12/2019 | Sato et al. | |
| 2004/0041862 | A1 | 3/2004 | Nakagawa et al. | |
| 2009/0189945 | A1 | 7/2009 | Sekiyama | 347/33 |
| 2010/0149290 | A1 * | 6/2010 | Misumi | B41J 2/17513 347/85 |
| 2011/0115846 | A1 | 5/2011 | Suzuki et al. | |
| 2011/0279525 | A1 * | 11/2011 | Suzuki | B41J 2/16585 347/30 |
| 2013/0100200 | A1 | 4/2013 | Hamasaki et al. | |
| 2014/0132664 | A1 | 5/2014 | Igawa et al. | 347/30 |
| 2018/0154630 | A1 | 6/2018 | Takahashi et al. | |
| 2018/0311960 | A1 | 11/2018 | Nakai et al. | |
| 2018/0311961 | A1 | 11/2018 | Kiuchi et al. | |
| 2019/0001670 | A1 | 1/2019 | Fukasawa et al. | |
| 2019/0009522 | A1 | 1/2019 | Fukasawa et al. | |
| 2019/0009553 | A1 | 1/2019 | Nakai et al. | |
| 2019/0009590 | A1 | 1/2019 | Fukasawa et al. | |
| 2019/0070855 | A1 | 3/2019 | Yamaguchi et al. | |
| 2019/0291438 | A1 | 9/2019 | Sasaki et al. | |
| 2020/0108611 | A1 | 4/2020 | Nakagawa et al. | |
| 2020/0108612 | A1 | 4/2020 | Nakagawa et al. | |

FOREIGN PATENT DOCUMENTS

| | | |
|---|---|---|
| CN | 102145582 | 8/2011 |
| CN | 108128037 | 6/2018 |
| JP | 2000-062215 | 2/2000 |
| JP | 2011-104864 A | 6/2011 |

* cited by examiner

FIG.12A
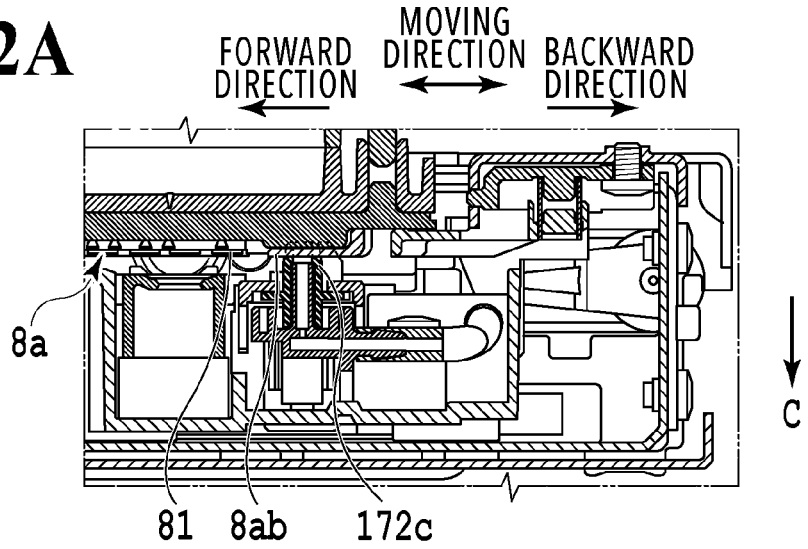
FIG.12B
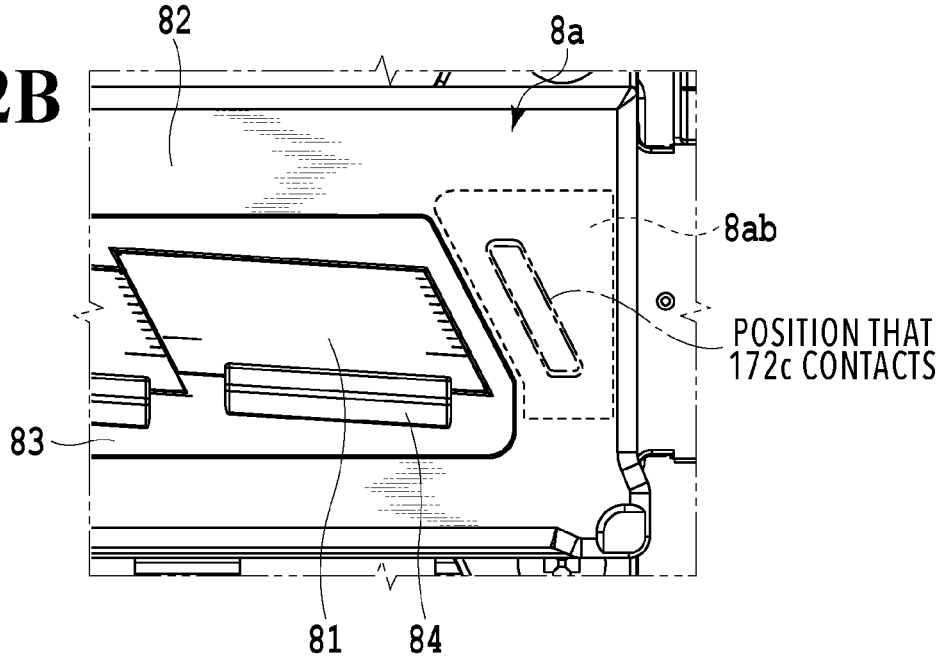
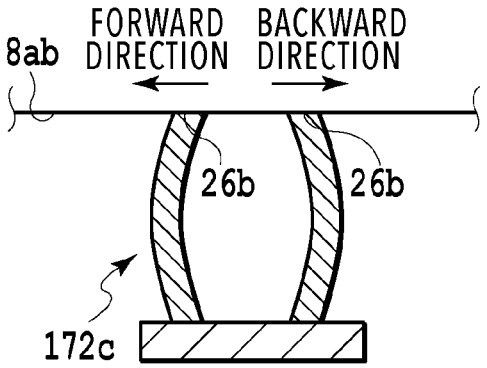
FIG.12C
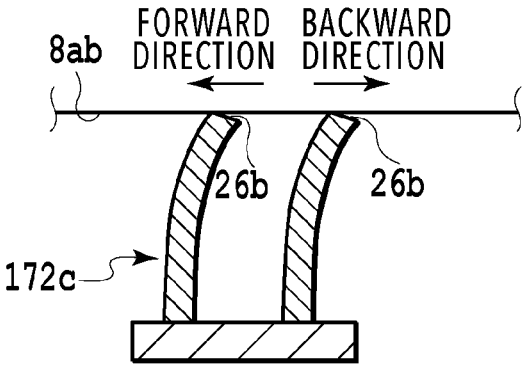
FIG.12D

INKJET PRINTING APPARATUS AND RECOVERY METHOD

BACKGROUND OF THE INVENTION

Field of the Invention

The present invention relates to inkjet printing apparatuses that eject ink onto print media to perform printing and recovery methods for keeping favorable the condition of ink ejection from the print head which ejects ink and also for recovering it.

Description of the Related Art

Japanese Patent Laid-Open No. 2011-104864 discloses an inkjet printing apparatus including a wiper unit capable of wiping while sucking. This inkjet printing apparatus performs what is called vacuum wiping in which a wiper unit is brought into contact with the print head, and performs wiping on the ejection opening surface on which ejection openings for ejecting ink are formed while performing sucking on the ejection opening surface with a suction pump. In this operation, the wiper unit is moved in the forward and backward directions, and the forward movement is performed with the higher negative pressure and the lower moving speed than the backward movement in order to ensure removal of ink and foreign objects and reduce the work time.

Meanwhile, vacuum wiping is performed, for example, in the following three cases: a case of removing foreign objects such as paper dust attached around the ejection openings or pushed into the ejection openings, a case of removing ink thickened in the ejection openings, and a case of removing bubbles generated in the ejection openings. To efficiently execute removal for each purpose in those three cases, the value of the negative pressure applied to the ejection openings and the operation time need to be set differently among the cases.

Unfortunately, the technique disclosed in Japanese Patent Laid-Open No. 2011-104864 is only a technique in which the value of applied negative pressure and the moving speed of the vacuum wiper are set differently between in the forward movement and in the backward movement in vacuum wiping, and hence, removal for each purpose cannot be executed efficiently.

SUMMARY OF THE INVENTION

The present invention provides an inkjet printing apparatus and recovery method capable of executing efficient vacuum wiping.

In the first aspect of the present invention, there is provided an inkjet printing apparatus comprising:

a printing unit having an ejection opening surface on which multiple ejection openings configured to eject ink are arrayed;

a wiping unit that has an opening and is capable of wiping the ejection opening surface by moving in a predetermined direction relative to the ejection opening surface with the opening in contact with the ejection opening surface;

a suction unit connected to the wiping unit and configured to apply negative pressure via the opening to the ejection opening surface in contact with the opening;

a moving unit configured to move the wiping unit in the predetermined direction relative to the ejection opening surface; and a control unit configured to perform suction wiping operation by wiping the ejection opening surface with the wiping unit while driving the suction unit to apply negative pressure to the ejection opening surface, wherein according to timing at which to perform the suction wiping operation, the control unit determines a moving speed of the wiping unit by the moving unit and a negative pressure value applied by the suction unit.

In the second aspect of the present invention, there is provided an inkjet printing apparatus comprising:

a printing unit having an ejection opening surface on which multiple ejection openings configured to eject ink are arrayed;

a wiping unit that has an opening and is capable of wiping the ejection opening surface by moving in a predetermined direction relative to the ejection opening surface with the opening in contact with the ejection opening surface;

a suction unit connected to the wiping unit and configured to apply negative pressure via the opening to the ejection opening surface in contact with the opening;

a moving unit configured to move the wiping unit in the predetermined direction relative to the ejection opening surface;

a control unit configured to perform suction wiping operation by wiping the ejection opening surface with the wiping unit while driving the suction unit to apply negative pressure to the ejection opening surface; and a pressure detection unit configured to detect a pressure value applied by the suction unit, wherein the control unit controls the suction wiping operation based on the pressure value detected by the pressure detection unit.

In the third aspect of the present invention, there is provided a recovery method used in an inkjet printing apparatus including a printing unit having an ejection opening surface on which multiple ejection openings configured to eject ink are arrayed and a wiping unit for wiping the ejection opening surface, the recovery method being for recovering ejection performance of the ejection openings by performing suction wiping operation in which the wiping unit is being moved relative to the ejection opening surface in a state where a suction unit is driven to apply negative pressure to the ejection opening surface, comprising determining, according to timing at which to perform the suction wiping operation, a moving speed of the wiping unit and a negative pressure value applied by the suction unit.

The present invention makes it possible to execute efficient vacuum wiping (suction wiping operation).

Further features of the present invention will become apparent from the following description of exemplary embodiments with reference to the attached drawings.

BRIEF DESCRIPTION OF THE DRAWINGS

FIGS. 12A, 12B, 12C, and 12D are explanatory diagrams for the contact between an ejection opening surface and the vacuum wiper;

DESCRIPTION OF THE EMBODIMENTS

Hereafter, embodiments of the present invention will be described in detail with reference to the drawings. The following embodiments are not intended to limit the present invention, and all the combinations of the features described in the present embodiments are not necessarily essential for the solutions provided by the present invention. Note that the relative positions, shapes, and the like of the constituents described in the embodiments are mere examples, and hence they are not intended to limit the scope of the invention only to those examples.

Figure 1:
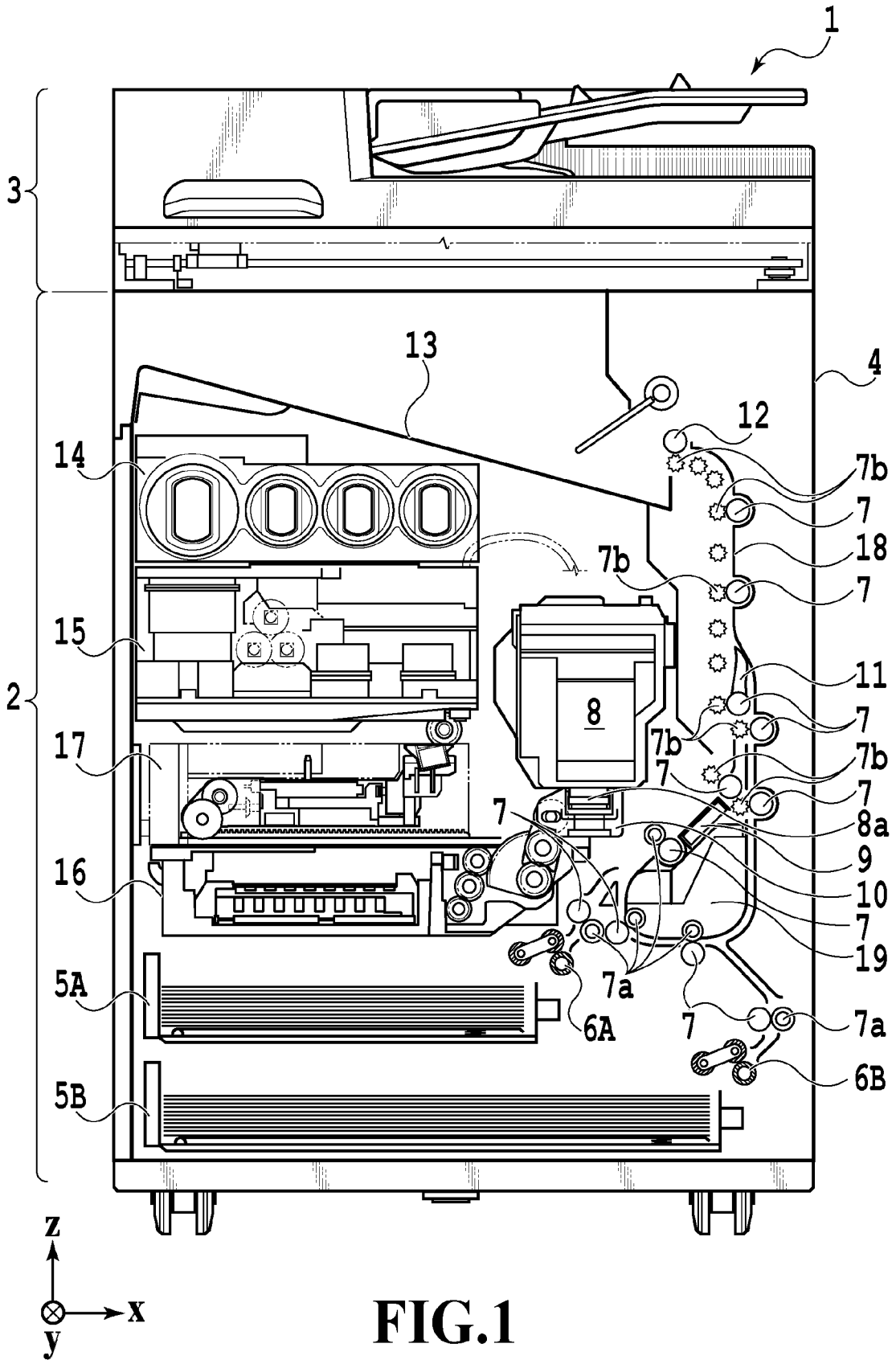
FIG. 1 is a view of a printing apparatus in a standby state.

FIG. 1 is a view of the internal configuration of an inkjet printing apparatus 1 (hereinafter, the printing apparatus 1) used in this embodiment. In FIG. 1, an x direction represents a horizontal direction, a y direction (direction normal to the sheet surface) represents a direction in which ejection ports are aligned in a later-described print head 8, and a z direction represents the vertical direction.

The printing apparatus 1 is a multifunction printer including a print unit 2 and a scanner unit 3. The printing apparatus 1 can use the print unit 2 and the scanner unit 3 separately or in synchronization to perform various processes related to print operation and scan operation. The scanner unit 3 includes an automatic document feeder (ADF) and a flatbed scanner (FBS) and is capable of scanning a document automatically fed by the ADF as well as scanning a document placed by a user on a document plate of the FBS. The present embodiment is directed to the multifunction printer including both the print unit 2 and the scanner unit 3, but the scanner unit 3 may be omitted. FIG. 1 shows the printing apparatus 1 in a standby state in which neither print operation nor scan operation is performed.

A first cassette 5A and a second cassette 5B that house print media (cut sheets) S are mounted in an attachable and detachable manner at a bottom portion of the print section 2 on the lower side of a housing 4 in the vertical direction. The first cassette 5A houses relatively small print media of up to a size of A4 in the form of a flat pile. The second cassette 5B houses relatively large print media of a size of up to A3 in the form of a flat pile. Near the first cassette 5A, a first feed unit 6A is provided which separately feeds the housed print media. Likewise, a second feed unit 6B is provided near the second cassette 5B. When a print operation is performed, a print medium S is fed selectively from one of the cassettes.

Conveying rollers 7, a discharge roller 12, pinch rollers 7*a*, spurs 7*b*, a guide 18, an inner guide 19, and a flapper 11 are conveying mechanisms (conveying unit) that guide print media S in predetermined directions. The conveying rollers 7 are drive rollers disposed upstream and downstream of the print head 8 and driven by a conveying motor not illustrated. The pinch rollers 7*a* are driven rollers that rotate while nipping a print medium S with the conveying rollers 7. The discharge roller 12 is a drive roller disposed downstream of the conveying rollers 7 and driven by a conveying motor not illustrated. The spurs 7*b* convey a print medium S while holding it between themselves and the conveying rollers 7 disposed downstream of the print head 8 and the discharge roller 12.

The guide 18 is provided along a conveying path for print media S and guides a print medium S in predetermined directions. The inner guide 19 is a member extending in the y direction and having a curved side surface and guides a print medium S along this side surface. The flapper 11 is a member that switches the direction of conveyance of a print medium S in a double-sided print operation. A discharge tray 13 is a tray on which to place and hold print media S discharged by the discharge roller 12 after completing their print operations.

The print head 8 of in the embodiments is a full-line color inkjet print head, in which the ejection openings capable of ejecting ink according to print data are arrayed along the y-direction of FIG. 1 by the length corresponding to the width of a print medium S. Specifically, the print head 8 is configured to be capable of ejecting ink of multiple colors. In the state in which the print head 8 is at a standby position, the ejection opening surface 8*a* of the print head 8 faces vertically downward and is capped with a cap unit 10 as illustrated in FIG. 1. In print operation, the orientation of the print head 8 is changed by a print controller 202 described later such that the ejection opening surface 8*a* faces a platen 9. The platen 9, composed of a flat plate extending in the y-direction, supports a print medium S from its back surface while the print head 8 is performing print operation on the print medium S. The movement of the print head 8 from the standby position to a printing position will be described later in detail.

An ink tank unit 14 stores inks of four colors to be supplied to the print head 8. An ink supply unit 15 is provided at a point along a flow channel connecting the ink tank unit 14 and the print head 8 and adjusts the pressure and flow rate of the inks inside the print head 8 within appropriate ranges. This embodiment employs a circulatory ink feed system. The ink supply unit 15 adjusts the pressure of the inks to be supplied to the print head 8 and the flow rate of the inks collected from the print head 8 within appropriate ranges.

A maintenance unit 16 includes the cap unit 10 and a wiping unit 17 and operates them with a predetermined timing to perform a maintenance operation on the print head 8. The maintenance operation will be described later in detail.

Figure 2:
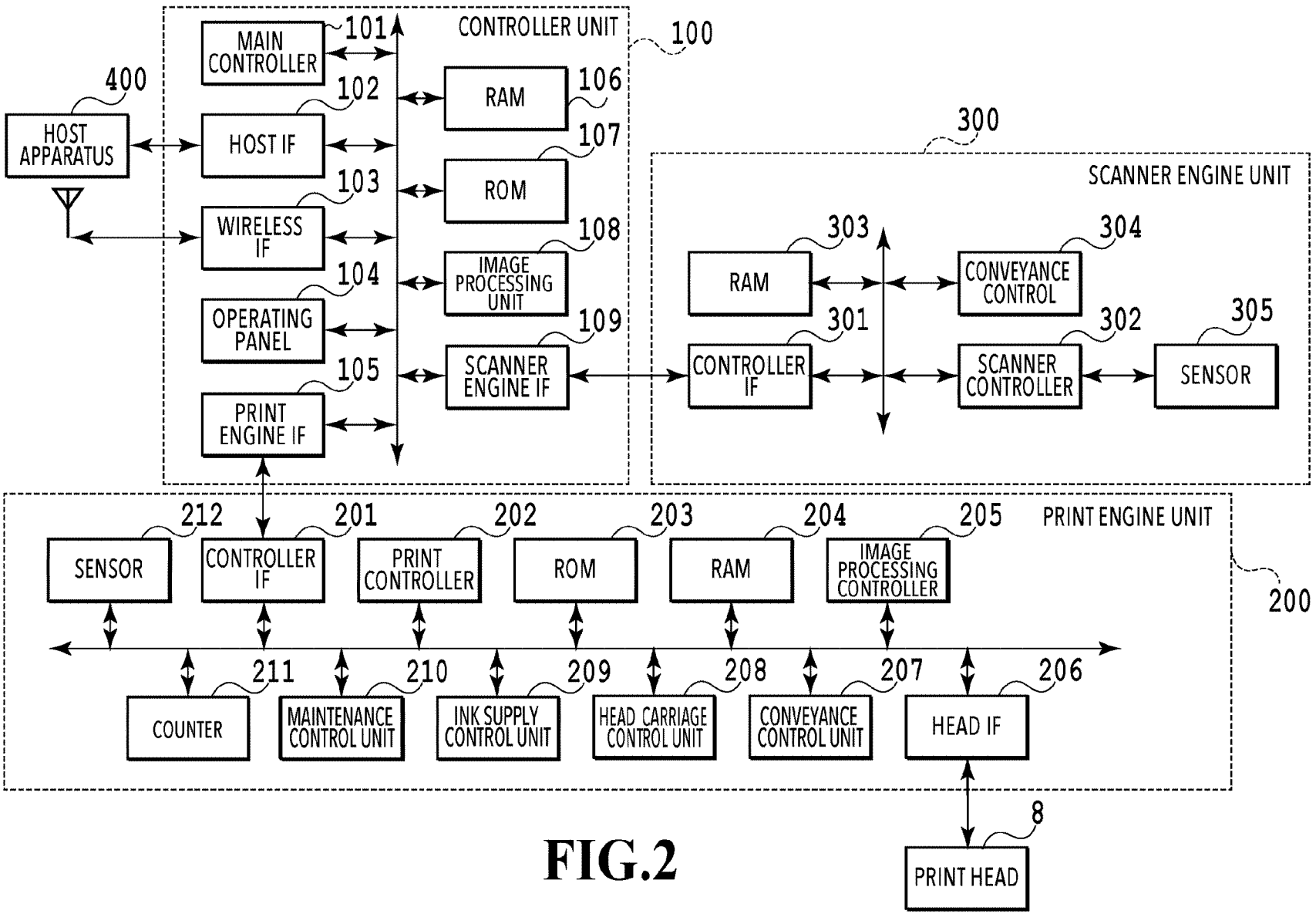
FIG. 2 is a diagram of a control configuration of the printing apparatus.

FIG. 2 is a block diagram illustrating a control configuration in the printing apparatus 1. The control configuration mainly includes a print engine unit 200 that controls the print section 2, a scanner engine unit 300 that controls the scanner section 3, and a controller unit 100 that controls the whole printing apparatus 1. The print controller 202 controls various mechanisms of the print engine unit 200 in accordance with instructions from a main controller 101 of the controller unit 100. Various mechanisms of the scanner engine unit 300 are controlled by the main controller 101 of the controller unit 100. Details of the control configuration will be described below.

In the controller unit 100, the main controller 101, configured of a CPU, controls the entire printing apparatus 1 by using an RAM 106 as a work area in accordance with programs and various parameters stored in an ROM 107. For example, upon input of a print job from a host apparatus 400 through a host I/F 102 or a wireless I/F 103, an image processing unit 108 performs predetermined image processing on received image data in accordance with an instruction from the main controller 101. The main controller 101 then transmits the image data after the image processing to the print engine unit 200 through a print engine I/F 105.

Meanwhile, the printing apparatus 1 may obtain image data from the host apparatus 400 by means of wireless communication or wired communication or from an external storage device (such as a USB memory) connected to the printing apparatus 1. The communication method used for the wireless communication or the wired communication is not particularly limited. For example, Wireless Fidelity (Wi-Fi) (registered trademark) or Bluetooth (registered trademark) can be employed as the communication method used for the wireless communication. Also, universal serial bus (USB) or the like can be employed as the communication method used for the wired communication. Further, for example, upon input of a read command from the host apparatus 400, the main controller 101 transmits this command to the scanner section 3 through a scanner engine I/F 109.

An operating panel 104 is a mechanism with which the user inputs and receives information into and from the printing apparatus 1. Through the operating panel 104, the user can instruct the controller unit 100 to perform operations such as photocopying and scanning, set a print mode, check information on the printing apparatus 1, and so on.

In the print engine unit 200, the print controller 202, configured of a CPU, controls various mechanisms of the print section 2 by using an RAM 204 as a work area in accordance with programs and various parameters stored in an ROM 203. Upon receipt of various commands and image data through a controller I/F 201, the print controller 202 temporarily stores them in an RAM 204. The print controller 202 causes an image processing controller 205 to convert the stored image data into print data so that the print head 8 can use the stored image data in a print operation. After the print data is generated, the print controller 202 causes the print head 8 to perform a print operation based on the print data through a head I/F 206. In doing so, the print controller 202 conveys a print medium S by driving the feed unit 6A or 6B, the conveying rollers 7, the discharge roller 12, and the flapper 11, which are illustrated in FIG. 1, through a conveyance control unit 207. A print process is performed by performing a print operation with the print head 8 in combination with the operation of conveying the print medium S in accordance with instructions from the print controller 202.

A head carriage control unit 208 changes the orientation and position of the print head 8 in accordance with the operation state of the printing apparatus 1 such as a maintenance state or a print state. An ink supply control unit 209 controls the ink supply unit 15 such that the pressure of the inks to be supplied to the print head 8 fall within an appropriate range. A maintenance control unit 210 controls the operation of the cap unit 10 and the wiping unit 17 of the maintenance unit 16 when a maintenance operation is performed on the print head 8. A counter 211 counts a predetermined time during maintenance processes such as a vacuum wiping process. A sensor 212 (detection unit) is disposed on the conveying path of print media S and configured to detect print media S being conveyed.

For the scanner engine unit 300, the main controller 101 controls hardware resources in a scanner controller 302 by using the RAM 106 as a work area in accordance with programs and various parameters stored in the ROM 107. As a result, various mechanisms of the scanner section 3 are controlled. For example, the main controller 101 controls hardware resources in the scanner controller 302 through a controller I/F 301 such that a document loaded on the ADF by the user is conveyed through a conveyance control unit 304 and read by a sensor 305. Then, the scanner controller 302 stores the read image data in an RAM 303. Meanwhile, by converting the image data thus obtained into print data, the print controller 202 can cause the print head 8 to perform a print operation based on the image data read by the scanner controller 302.

Figure 3:
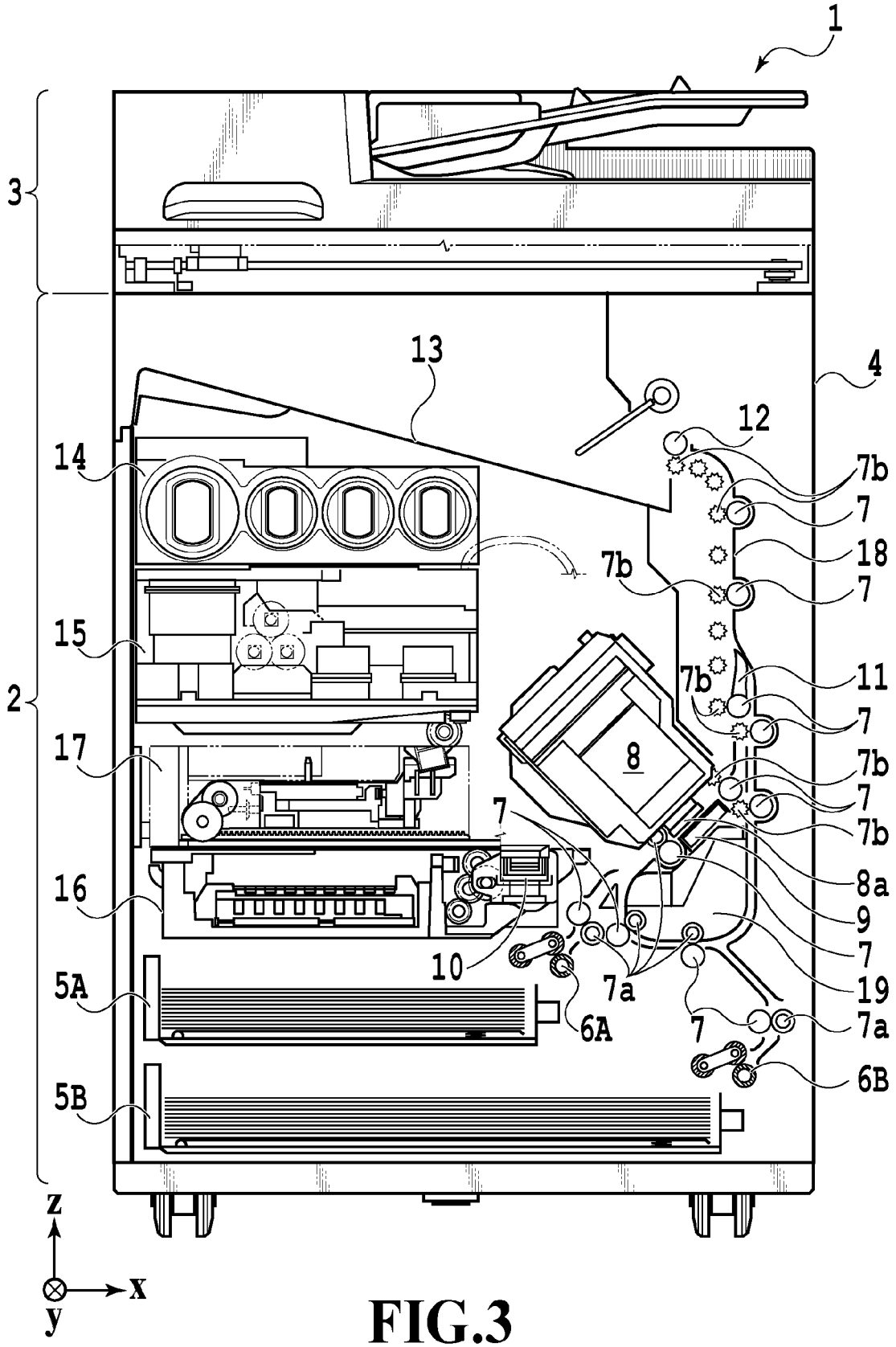
FIG. 3 is a view of the printing apparatus in a print state.

FIG. 3 illustrates the printing apparatus 1 in a print state. In contrast to the standby state illustrated in FIG. 1, the cap unit 10 is separated from the ejection opening surface 8*a* of the print head 8, and the ejection opening surface 8*a* is facing the platen 9. In this embodiment, the plane of the platen 9 is tilted at approximate 45 degrees with respect to the horizontal direction, and the ejection opening surface 8*a* of the print head 8 at the print position is also tilted at approximately 45 degrees with respect to the horizontal direction so that the distance between the ejection opening surface 8*a* and the platen 9 can be kept at a fixed distance.

When the print head 8 is moved from the standby position illustrated in FIG. 1 to the print position illustrated in FIG. 3, the print controller 202 lowers the cap unit 10 to a retreat position illustrated in FIG. 3 by using the maintenance control unit 210. As a result, the ejection opening surface 8*a* of the print head 8 is separated from a cap member 10*a*. Then, using the head carriage control unit 208, the print controller 202 turns the print head 8 by 45 degrees while adjusting its height level in the vertical direction, to thereby make the ejection opening surface 8*a* face the platen 9. The print controller 202 performs the reverse of the above steps when moving the print head 8 from the print position to the standby position after a print operation is completed.

Next, the conveying paths for print media S in the print section 2 will be described. Upon input of a print command, the print controller 202 firstly moves the print head 8 to the print position illustrated in FIG. 3 by using the maintenance control unit 210 and the head carriage control unit 208. The print controller 202 then drives the first feed unit 6A or the second feed unit 6B based on the print command and feeds a print medium S by using the conveyance control unit 207.

Figure 4C:
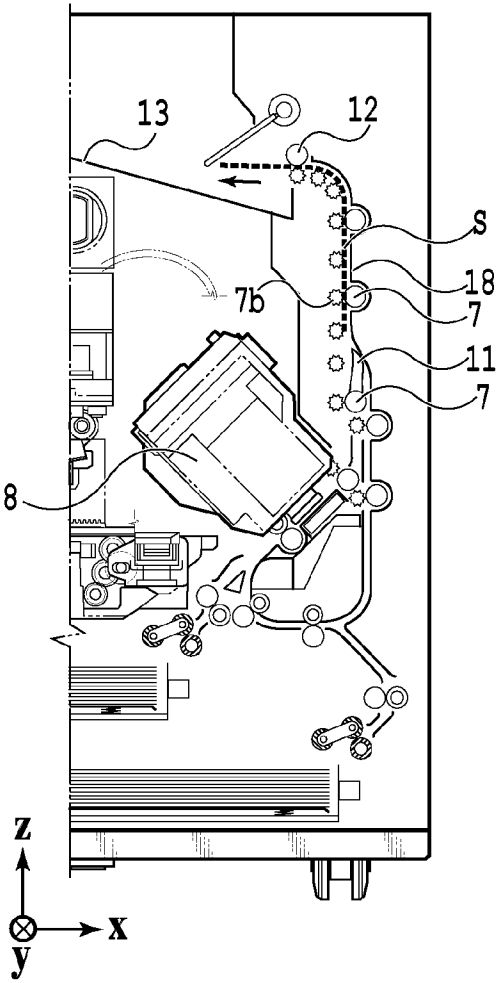
FIGS. 4A, 4B, and 4C are views of a conveying path of a print medium fed from a first cassette.
Figure 4B:
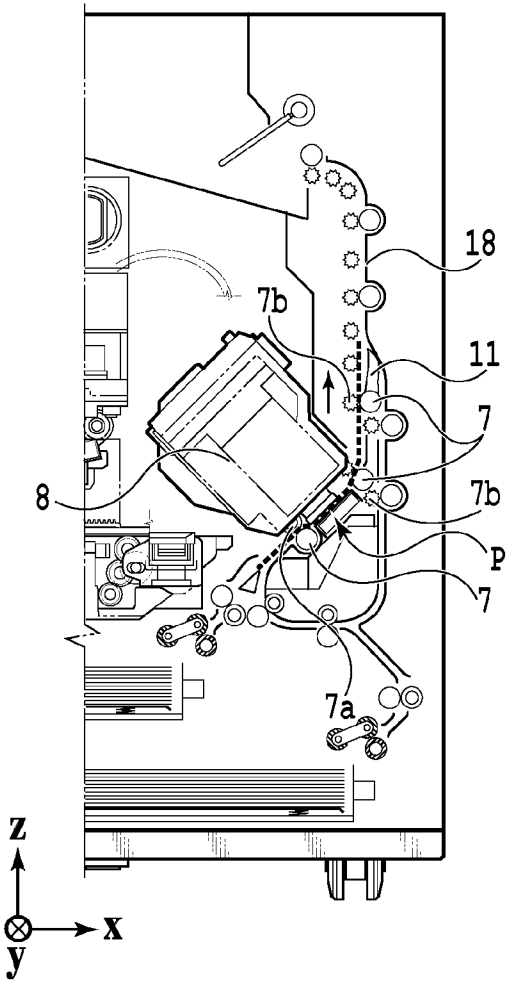
Figure 4A:
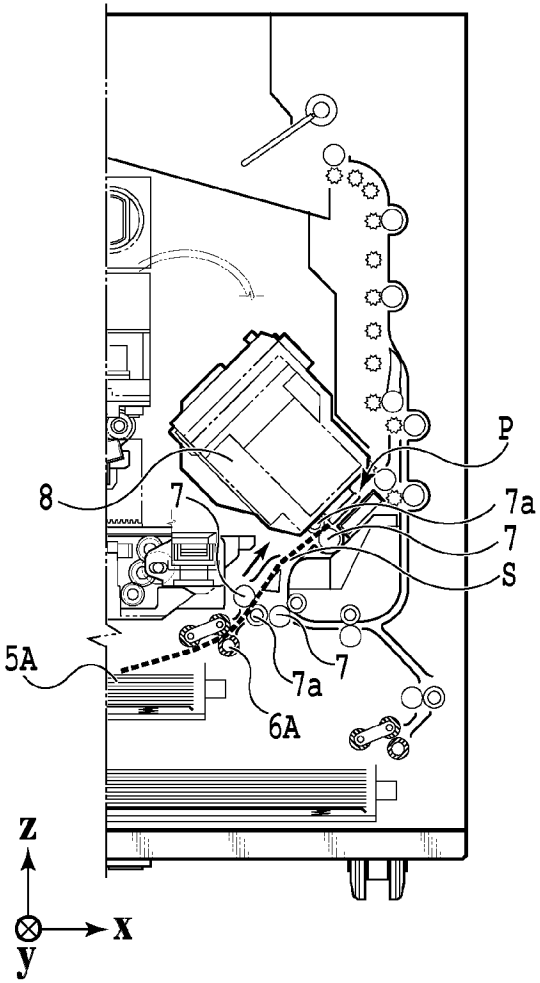

FIGS. 4A to 4C are views illustrating a conveying path used in a case of feeding an A4 print medium S stored in the first cassette 5A. The print medium S stacked at the top in the first cassette 5A is separated from the second and lower print media by the first feed unit 6A and conveyed toward a printing region P between the platen 9 and the print head 8 while being nipped between some conveying rollers 7 and pinch rollers 7*a*. FIG. 4A illustrates a conveying state immediately before the leading edge of the print medium S reaches the printing region P. The direction of travel of the print medium S is changed from the horizontal direction (x direction) to a direction tilted at approximately 45 degrees with respect to the horizontal direction by the time the print medium S reaches the printing region P after being fed by the first feed unit 6A.

At the printing region P, the inks are ejected toward the print medium S from the plurality of ejection ports provided in the print head 8. The platen 9 supports the back surface of the region of the print medium S to which the inks are to be applied, and the distance between the ejection port surface 8*a* and the print medium S is kept at a fixed distance. After the inks are applied, the print medium S passes the left side of the flapper 11, whose tip is tilted toward the right side, and is conveyed upward in the vertical direction of the printing apparatus 1 along the guide 18 while being guided by some conveying rollers 7 and spurs 7*b*. FIG. 4B illustrates a state where the leading edge of the print medium S has passed the printing region P and is being conveyed upward in the vertical direction. The direction of travel of the print medium S has been changed to the vertically upward direction by the conveying rollers 7 and spurs 7*b* from the position of the printing region P, which is tilted at approximately 45 degrees with respect to the horizontal direction.

After being conveyed vertically upward, the print medium S is discharged onto the discharge tray 13 by the discharge roller 12 and the spur 7*b*. FIG. 4C illustrates a state where the leading edge of the print medium S has passed the discharge roller 12 and is being discharged onto the discharge tray 13. The print medium S after being discharged is held on the discharge tray 13 in a state where its surface on which the image was printed by the print head 8 faces down.

Figure 5C:
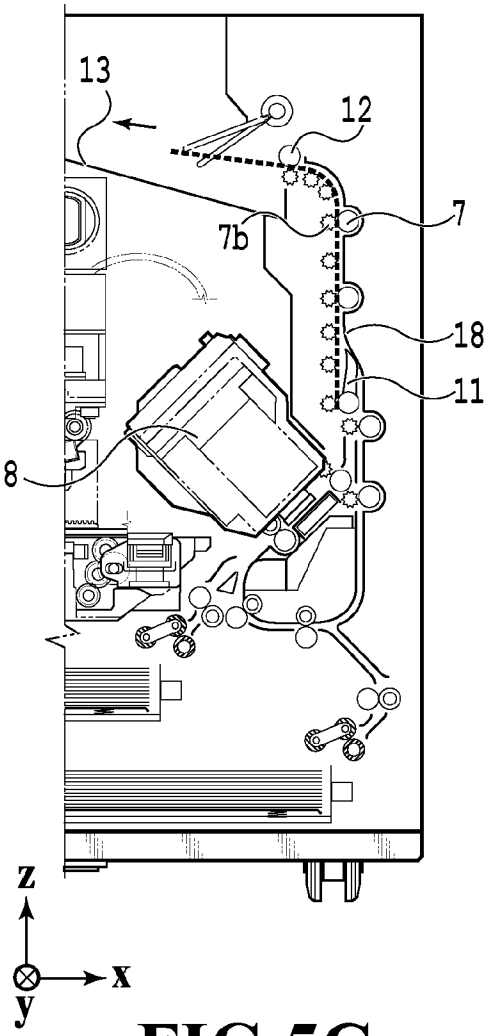
FIGS. 5A, 5B, and 5C are views of a conveying path of a print medium fed from a second cassette.
Figure 5B:
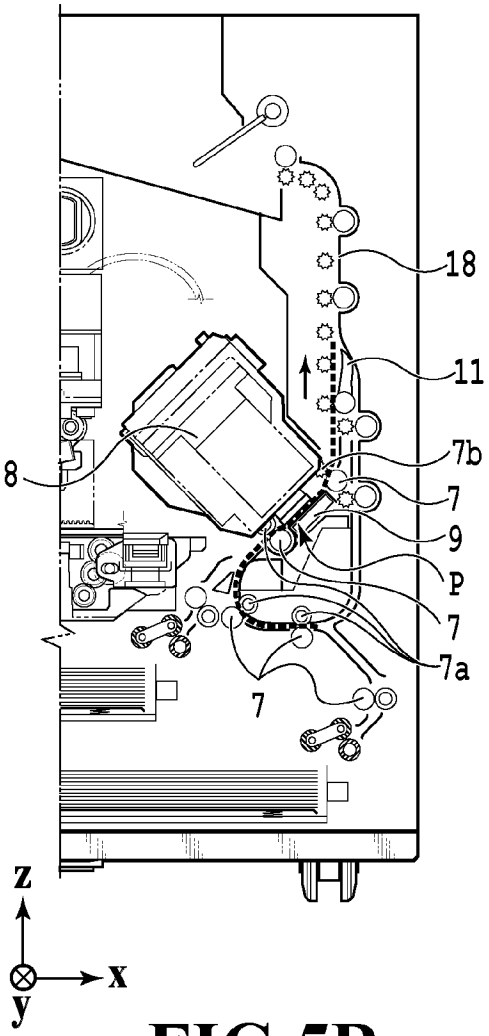
Figure 5A:
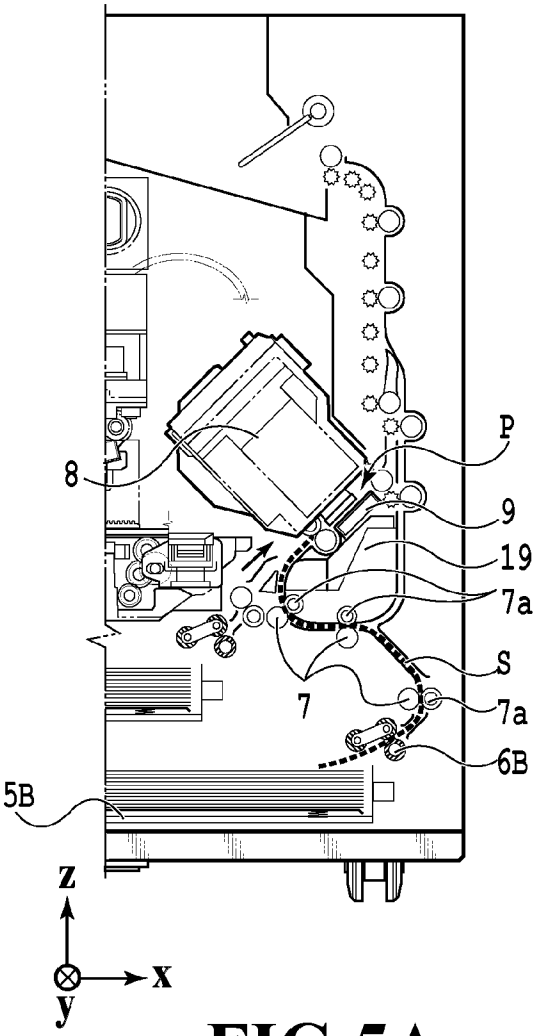

FIGS. 5A to 5C are views illustrating a conveying path used in a case of feeding an A3 print medium S stored in the second cassette 5B. The print medium S stacked at the top in the second cassette 5B is separated from the second and lower print media by the second feed unit 6B and conveyed toward the printing region P between the platen 9 and the print head 8 while being nipped between some conveying rollers 7 and pinch rollers 7*a*.

FIG. 5A illustrates a conveying state immediately before the leading edge of the print medium S reaches the printing region P. Pluralities of conveying rollers 7 and pinch rollers 7*a* and the inner guide 19 are disposed along the conveying path from the point at which the print medium P is fed by the second feed unit 6B to the point at which the print medium P reaches the printing region P. Hence, the print medium P is conveyed to the platen 9 while being curved in an S-shape.

The subsequent part of the conveying path is the same as that in the case with an A4 print medium S illustrated in FIG. 4B and FIG. 4C. FIG. 5B illustrates a state where the leading edge of the print medium S has passed the printing region P and is being conveyed upward in the vertical direction. FIG. 5C illustrates a state where the leading edge of the print medium S has passed the discharge roller 12 and is being discharged onto the discharge tray 13.

FIGS. 6A to 6D illustrate a conveying path used in a case of performing a print operation on the back surface (second surface) of an A4 print medium S (double-sided printing). In the case of performing double-sided printing, printing is performed on a first surface (front surface) and thereafter a print operation is performed on a second surface (back surface). The conveyance steps for performing the first surface printing are the same as FIG. 4A, FIG. 4B, and FIG. 4C and description thereof will therefore be omitted here. The conveyance steps following FIG. 4C will be described below.

Figures 6A, 6B, 6C, 6D:
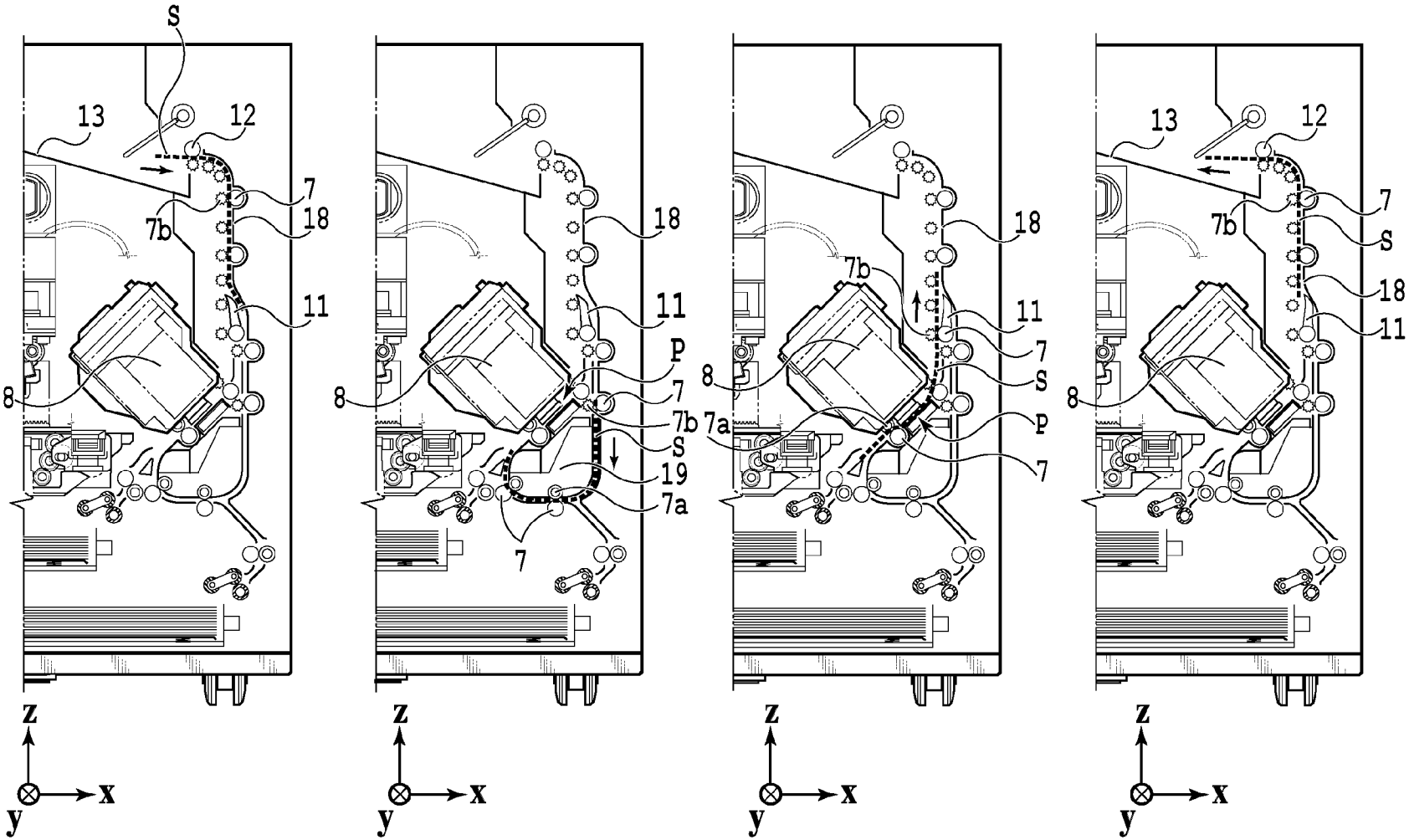
FIGS. 6A, 6B, 6C, and 6D are views of views of a conveying path used in a case of performing a print operation on the back surface of a print medium.

After the print operation on the first surface by the print head 8 is completed and the trailing edge of the print medium S passes the flapper 11, the print controller 202 rotates the conveying rollers 7 in the opposite direction to thereby convey the print medium S to the inner side of the printing apparatus 1. At this moment, the flapper 11 is controlled by an actuator not illustrated such that its tip is tilted toward the left side. Thus, the leading edge of the print medium S (the trailing edge in the print operation on the first surface) passes the right side of the flapper 11 and is conveyed downward in the vertical direction. FIG. 6A illustrates a state where the leading edge of the print medium S (the trailing edge in the print operation on the first surface) is passing the right side of the flapper 11.

Thereafter, the print medium S is conveyed along the curved outer circumferential surface of the inner guide 19 and conveyed to the printing region P between the print head 8 and the platen 9 again. This time, the second surface of the print medium S faces the ejection port surface 8*a* of the print head 8. FIG. 6B illustrates a conveyance state immediately before the leading edge of the print medium S reaches the printing region P for the print operation on the second surface.

The subsequent part of the conveying path is the same as that for the first surface printing illustrated in FIG. 4B and FIG. 4C. FIG. 6C illustrates a state where the leading edge of the print medium S has passed the printing region P and is being conveyed upward in the vertical direction. At this moment, the flapper 11 is controlled by the actuator not illustrated to move to the position at which its tip is tilted toward the right side. FIG. 6D illustrates a state where the leading edge of the print medium S has passed the discharge roller 12 and is being discharged onto the discharge tray 13.

Next, the maintenance operation on the print head 8 will be described. As also described with reference to FIG. 1, the maintenance unit 16 in this embodiment includes the cap unit 10 and the wiping unit 17 and operates them with a predetermined timing to perform the maintenance operation.

Figure 7:
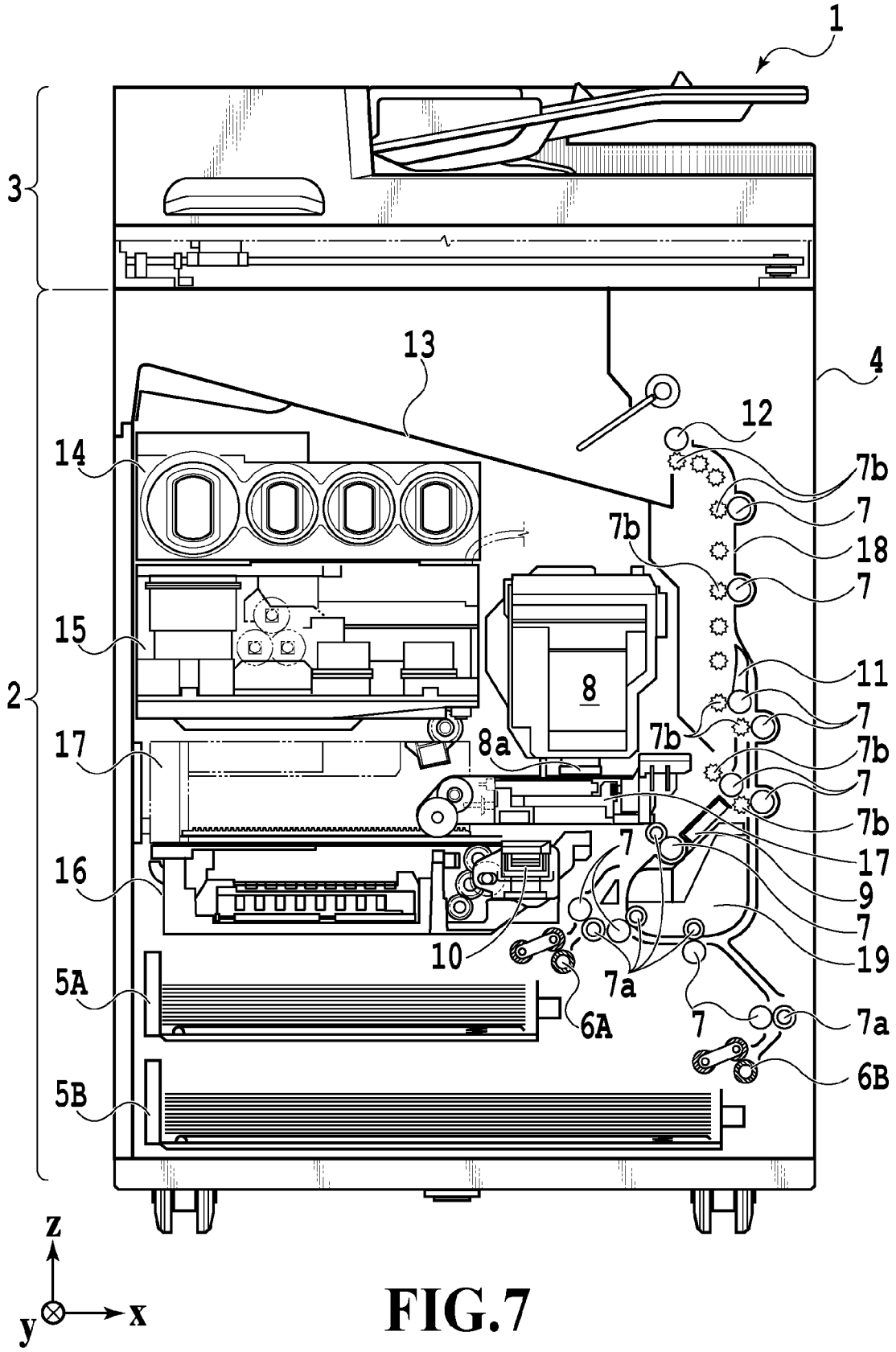
FIG. 7 is a view of the printing apparatus in a maintenance state.

FIG. 7 is a view of the printing apparatus 1 in the maintenance state. To move the print head 8 from the standby position illustrated in FIG. 1 to a maintenance position illustrated in FIG. 7, the print controller 202 moves the print head 8 upward in the vertical direction and moves the cap unit 10 downward in the vertical direction. The print controller 202 then moves the wiping unit 17 in the rightward direction in FIG. 7 from its retreat position. The print controller 202 thereafter moves the print head 8 downward in the vertical direction to thereby move it to the maintenance position, at which the maintenance operation can be performed.

Also, to move the print head 8 from the print position illustrated in FIG. 3 to the maintenance position illustrated in FIG. 7, the print controller 202 moves the print head 8 upward in the vertical direction while turning it by 45 degrees. The print controller 202 then moves the wiping unit 17 in the rightward direction from its retreat position. The print controller 202 thereafter moves the print head 8 downward in the vertical direction to thereby move it to the maintenance position, at which the maintenance operation by the maintenance unit 16 can be performed.

Figure 8A:
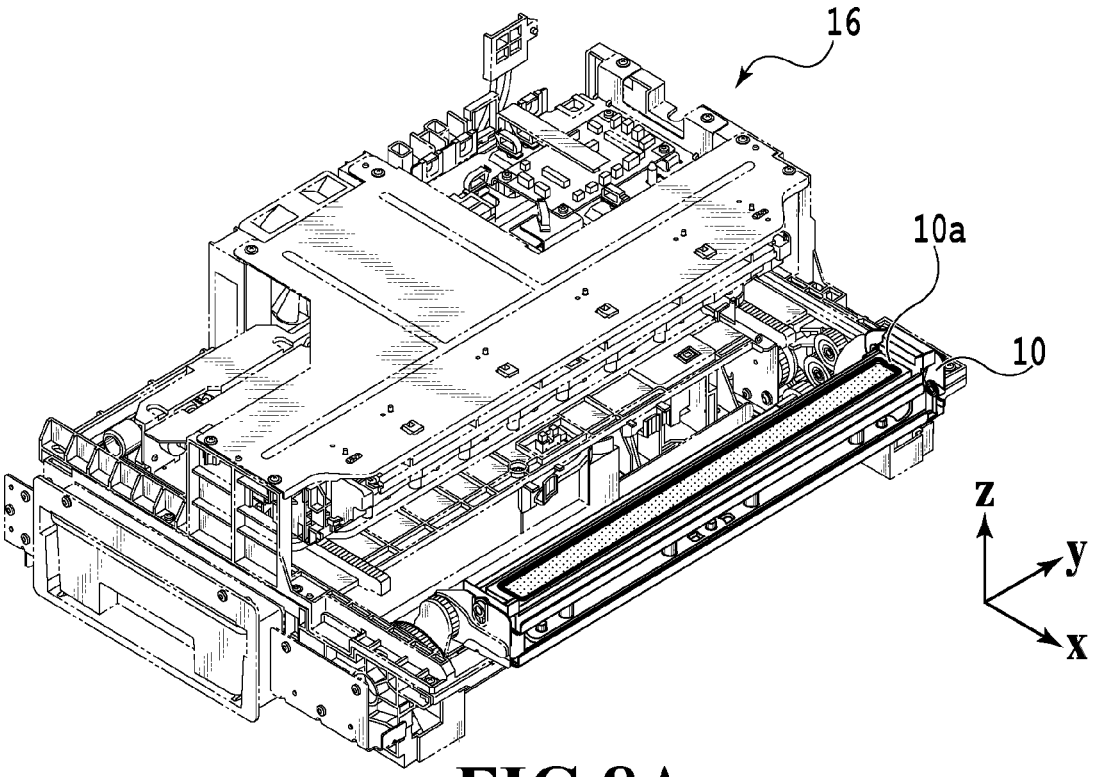
FIGS. 8A and 8B are perspective views illustrating the configuration of a maintenance unit.
Figure 8B:
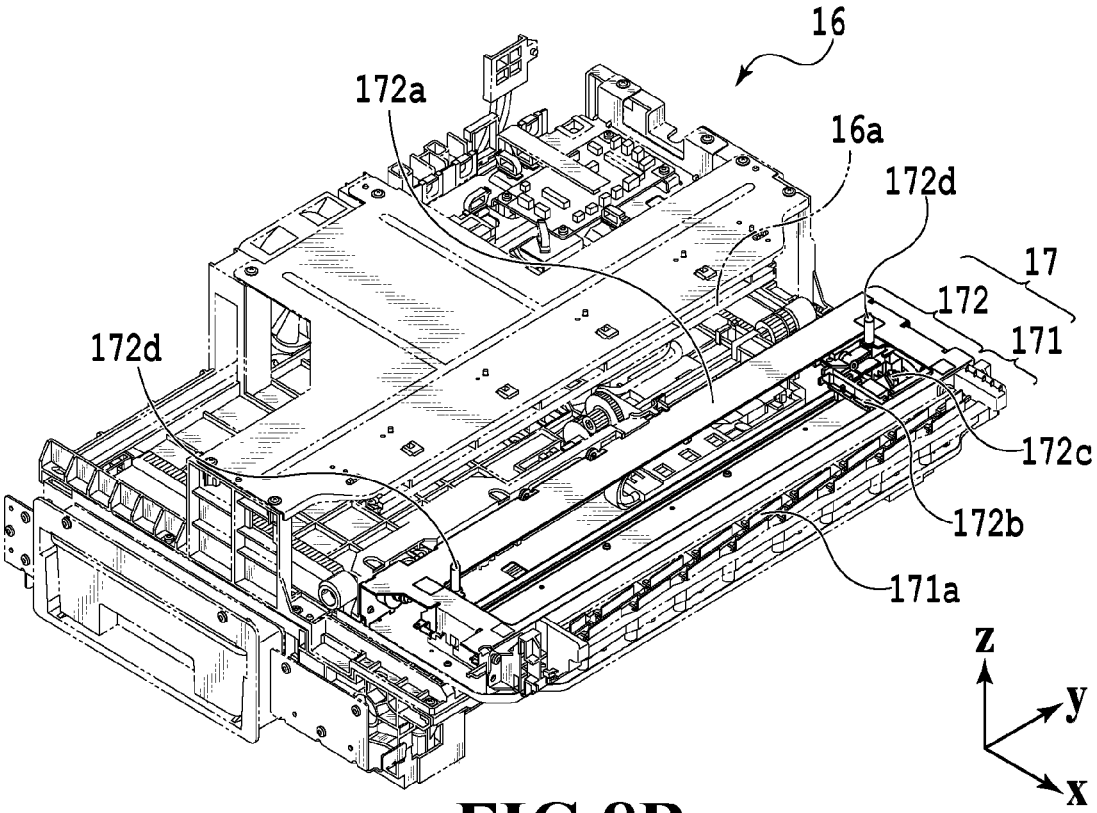

FIG. 8A is a perspective view illustrating the maintenance unit 16 at its standby position. FIG. 8B is a perspective view illustrating the maintenance unit 16 at its maintenance position. FIG. 8A corresponds to FIG. 1, and FIG. 8B corresponds to FIG. 7. When the print head 8 is at its standby position, the maintenance unit 16 is at its standby position illustrated in FIG. 8A and therefore the cap unit 10 is moved upward in the vertical direction and the wiping unit 17 is housed in the maintenance unit 16. The cap unit 10 includes the cap member 10*a*, which is in a box shape extending in the y direction. With this brought into tight contact with the ejection port surface 8*a* of the print head 8, the cap unit 10 can reduce evaporation of the inks through the ejection ports. The cap unit 10 also has a function of collecting the inks ejected onto the cap member 10*a* for preliminary ejection or the like and sucking the collected inks with a suction pump 24 (described later).

On the other hand, at the maintenance position illustrated in FIG. 8B, the cap unit 10 is moved downward in the vertical direction and the wiping unit 17 is pulled out of the maintenance unit 16. The wiping unit 17 includes two wiper units, namely a blade wiper unit 171 and a vacuum wiper unit 172. Wiping operation performed by these two wiper units keep favorable the ejection performance of the ejection openings formed on the ejection opening surface 8*a* and also recover it.

In the blade wiper unit 171, blade wipers 171*a* that wipe the ejection port surface 8*a* in the x direction are disposed along the y direction over a length corresponding to the region along which the ejection ports are aligned. To perform a wiping operation using the blade wiper unit 171, the wiping unit 17 moves the blade wiper unit 171 in the x direction with the print head 8 positioned at such a height level that the print head 8 can contact the blade wipers 171*a*. With this movement, the blade wipers 171*a* wipe the inks and the like attached to the ejection port surface 8*a*.

At the inlet of the maintenance unit 16 through which the blade wipers 171*a* are housed, a wet wiper cleaner 16*a* is disposed which removes the inks attached to the blade wipers 171*a* and applies a wetting liquid to the blade wipers 171*a*. Each time the blade wipers 171*a* are housed into the maintenance unit 16, the matters attached to the blade wipers 171*a* are removed and the wetting liquid is applied thereto by the wet wiper cleaner 16*a*. Then, the next time the blade wipers 171*a* wipe the ejection port surface 8*a*, the wetting liquid is transferred onto the ejection port surface 8*a*, thereby improving the lubricity between the ejection port surface 8*a* and the blade wipers 171*a*.

On the other hand, the vacuum wiper unit 172 includes a flat plate 172*a* with an opening portion extending in the y direction, a carriage 172*b* capable of moving in the y direction within the opening portion, and a vacuum wiper 172*c* mounted on the carriage 172*b*. The vacuum wiper 172*c* is disposed so as to be capable of wiping the ejection port surface 8*a* in they direction with movement of the carriage 172*b*. At the tip of the vacuum wiper 172*c*, a suction port (opening 26*a* described later) is formed which is connected to a suction pump 24. Thus, by moving the carriage 172*b* in they direction with the suction pump 24 actuated, the inks and the like attached to the ejection port surface 8*a* of the print head 8 are wiped by the vacuum wiper 172*c* and sucked into the suction port. In this operation, the flat plate 172*a* and positioning pins 172*d* provided at opposite ends of its opening portion are used to position the vacuum wiper 172*c* relative to the ejection port surface 8*a*.

In this embodiment, it is possible to perform a first wiping process in which the wiping operation by the blade wiper unit 171 is performed but the wiping operation by the vacuum wiper unit 172 is not performed and a second wiping process in which both wiping processes are sequentially performed. To perform the first wiping process, the print controller 202 first pulls the wiping unit 17 out of the maintenance unit 16 with the print head 8 retreated to above the maintenance position in FIG. 7 in the vertical direction. The print controller 202 then moves the print head 8 downward in the vertical direction to such a position that the print head 8 can contact the blade wipers 171*a*, and thereafter moves the wiping unit 17 to the inside of the maintenance unit 16. With this movement, the blade wipers 171*a* wipe the inks and the like attached to the ejection port surface 8*a*. Specifically, the blade wipers 171*a* wipe the ejection port surface 8*a* as they are moved from the position to which the wiping unit 17 has been pulled out of the maintenance unit 16 to the inside of the maintenance unit 16.

After housing the blade wiper unit 171, the print controller 202 moves the cap unit 10 upward in the vertical direction to thereby bring the cap member 10*a* into tight contact with the ejection port surface 8*a* of the print head 8. The print controller 202 then drives the print head 8 in this state to cause it to perform preliminary ejection, and sucks the inks collected in the cap member 10*a* with the suction pump 24.

On the other hand, to perform the second wiping process, the print controller 202 first slides the wiping unit 17 to pull it out of the maintenance unit 16 with the print head 8 retreated to above the maintenance position in FIG. 7 in the vertical direction. The print controller 202 then moves the print head 8 downward in the vertical direction to such a position that the print head 8 can contact the blade wipers 171*a*, and thereafter moves the wiping unit 17 to the inside of the maintenance unit 16. As a result, the wiping operation by the blade wipers 171*a* is performed on the ejection port surface 8*a*. Subsequently, the print controller 202 slides the wiping unit 17 to pull it out of the maintenance unit 16 to a predetermined position with the print head 8 retreated to above the maintenance position in FIG. 7 in the vertical direction again. The print controller 202 then positions the ejection port surface 8*a* and the vacuum wiper unit 172 relative to each other by using the flat plate 172*a* and the positioning pins 172*d* while lowering the print head 8 to the maintenance position illustrated in FIG. 7. The print controller 202 thereafter performs the above-described wiping operation by the vacuum wiper unit 172. The print controller 202 retreats the print head 8 upward in the vertical direction and houses the wiping unit 17, and then performs preliminary ejection into the cap member and the operation of sucking the collected inks with the cap unit 10, as in the first wiping process.

Next, a detailed configuration of the vacuum wiper unit 172 and details of the wiping operation performed by the vacuum wiper unit 172 will be described with reference to FIGS. 9A to 15.

The wiping operation using the vacuum wiper unit 172 (hereinafter referred to as "vacuum wiping" or a "vacuum wiping operation" as appropriate) is executed, as described above, after the wiping operation with the blade wiper unit has finished in the second wiping process. In the present embodiment, this vacuum wiping operation (suction wiping operation) is executed at the timing according to the purpose of removal and based on the process condition according to the purpose of removal. However, the present invention also includes a configuration in which only the vacuum wiping operation is performed alone without executing the wiping operation with the blade wiper unit.

(Configuration of Vacuum Wiper 172*c*)

Figure 9A:
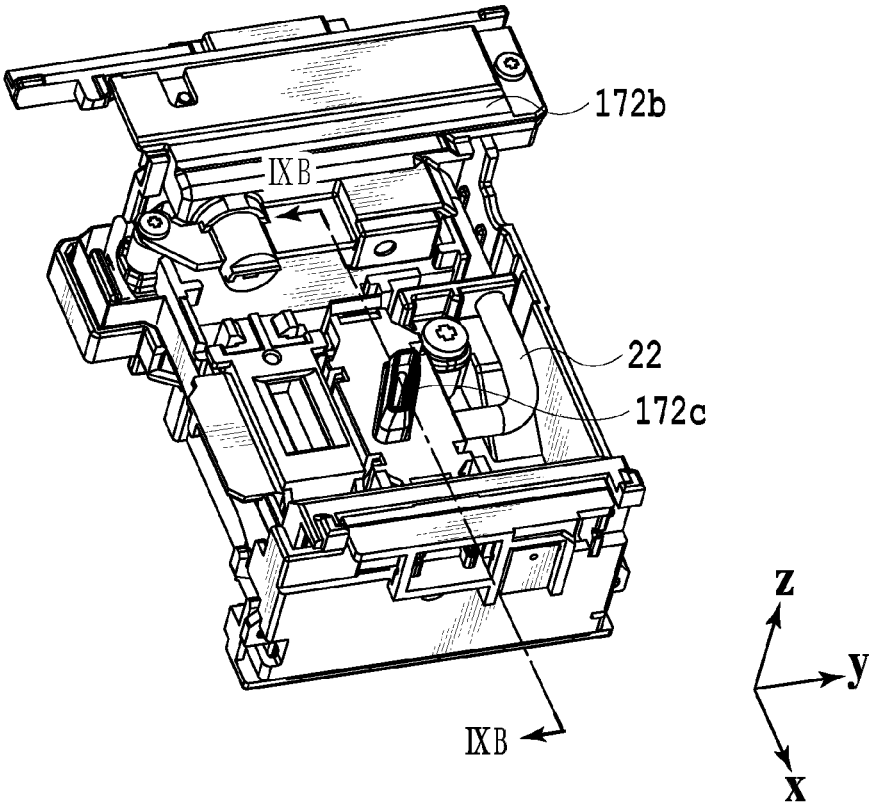
FIGS. 9A and 9B are schematic configuration diagrams of a vacuum wiper.
Figure 9B:
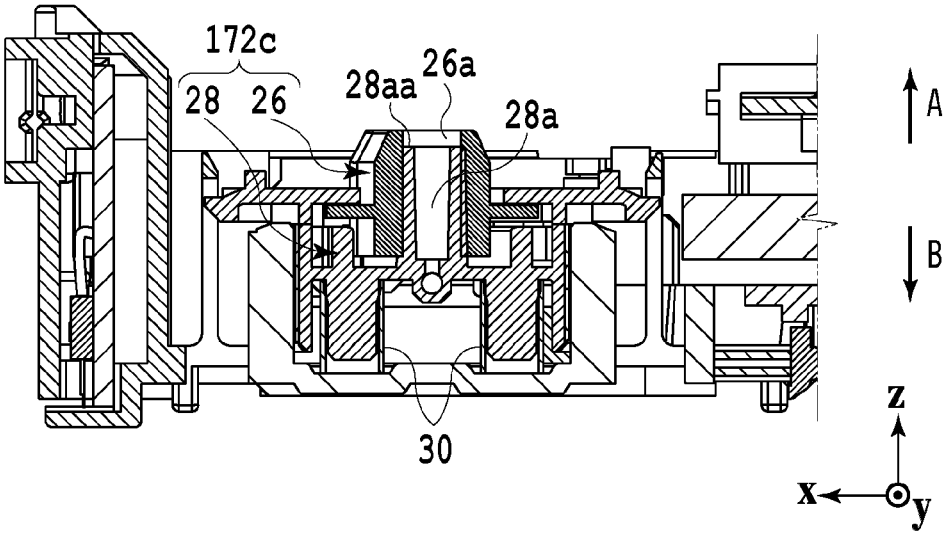

First the configuration of the vacuum wiper 172*c* will be described with reference to FIGS. 9A and 9B. FIG. 9A is a diagram illustrating the vacuum wiper 172*c* mounted on the carriage 172*b*. FIG. 9B is a cross-sectional view of the vacuum wiper 172*c* taken along line IXB-IXB in FIG. 9A.

The vacuum wiper 172*c* (wiping unit) has an opening (opening 26*a* described later) adapted to come into contact with the ejection opening surface 8*a* and apply negative pressure to it and is capable of wiping the ejection opening surface 8*a* by moving in the forward direction (−y-direction). The vacuum wiper 172*c* includes an elastic member 26 which comes into contact with the ejection opening surface 8*a* of the print head 8 (printing unit) and a support member 28 which supports the elastic member 26.

The support member 28 extends in the z-direction and has a hollow protrusion 28*a* the upper end 28*aa* of which is open. The support member 28 is connected to the suction pump 24 (suction unit) via a tube 22 and other parts (see FIG. 11A), and the inside of the protrusion 28*a* is depressurized by the suction pump 24 driven under the control of the print controller 202. The support member 28 is configured to be movable in the z-direction within a predetermined range and is always urged in the arrow-A direction by an urging member 30 such as a spring.

With this configuration, in the case where the ejection opening surface 8*a* comes into contact with the vacuum wiper 172*c*, the vacuum wiper 172*c* moves in the arrow-B direction against the urging force of the urging member 30. Thus, in the state where the vacuum wiper 172*c* and the ejection opening surface 8*a* are in contact with each other, the vacuum wiper 172*c* presses the ejection opening surface 8*a* with the urging force of the urging member 30.

A protrusion 28*a* of the support member 28 is inserted and fitted inside the elastic member 26. The elastic member 26 extends in the z-direction and is designed such that the upper end of the elastic member 26 is located higher than the upper end 28*aa* of the protrusion 28*a*. Note that the positional relationship between the vacuum wiper 172*c* and the print head 8 in the z-direction is adjusted such that in the case where the vacuum wiper 172*c* and the ejection opening surface 8*a* come into contact with each other, the elastic member 26 comes into contact with the ejection opening surface 8*a* but the support member 28 does not.

The elastic member 26 is formed of, for example, rubber or the like which is a material that does not cause or is less likely to cause damage to the ejection opening surface 8*a* and an ejection unit 81 (see FIG. 12B) provided on the ejection opening surface 8*a* even though the elastic member 26 moves being in contact with the ejection opening surface 8*a*. The elastic member 26 has the opening 26*a* at its upper end. In the state where the vacuum wiper 172*c* is in contact with a suction preparation surface 8*ab* (described later) of the ejection opening surface 8*a*, the opening 26*a* is closed by the suction preparation surface 8*ab*. The opening 26*a* is inclined in the x-direction at a predetermined angle.

Figure 10A:
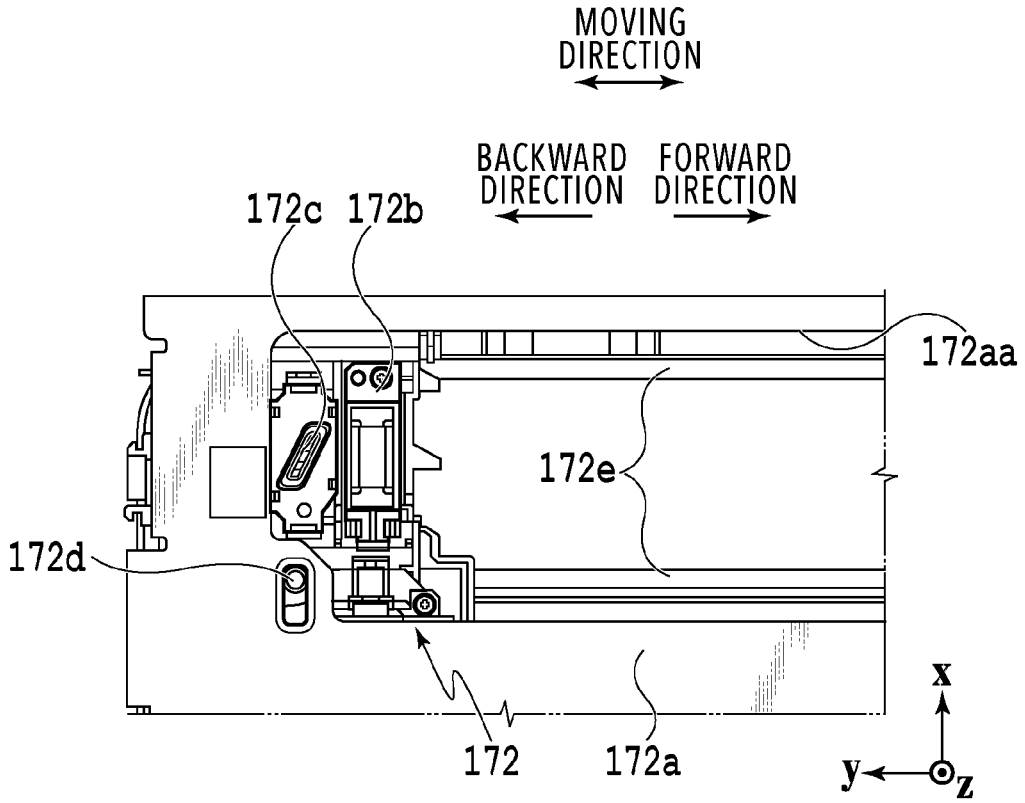
FIGS. 10A and 10B are explanatory diagrams of a carriage movement mechanism.
Figure 10B:
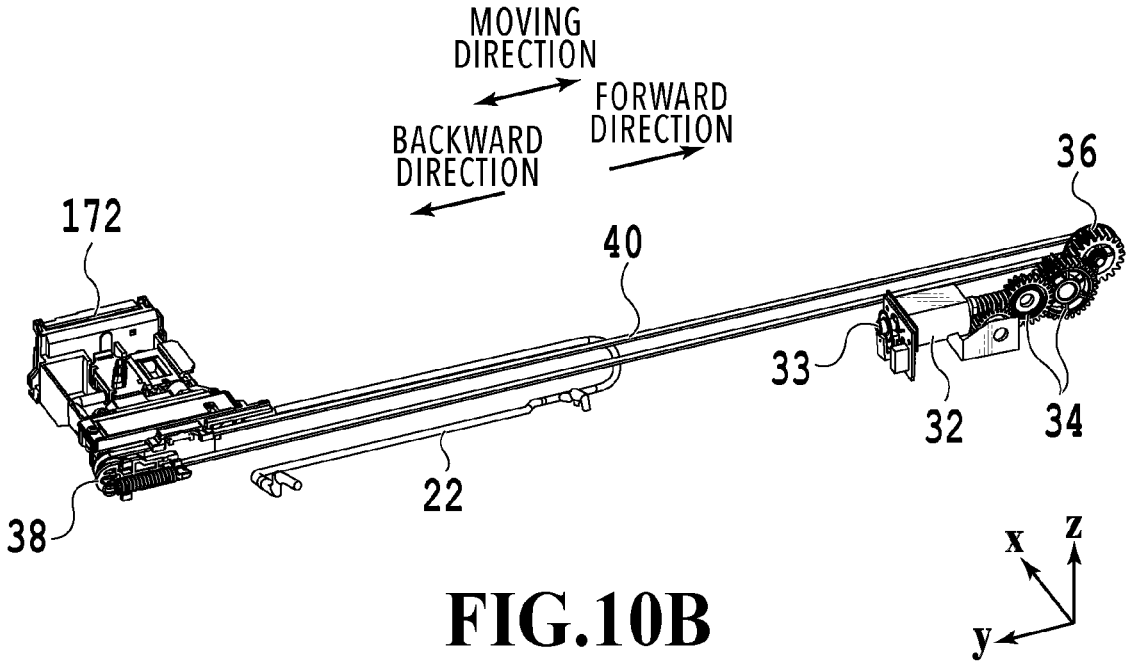

Next the movement mechanism of the carriage 172*b* on which the vacuum wiper 172*c* is mounted will be described with reference to FIGS. 10A and 10B. FIG. 10A is an enlarged view of one end and its vicinities of an opening 172*aa* of a flat plate 172*a* on which the carriage 172*b* is located. FIG. 10B is a schematic configuration diagram of a movement mechanism of the carriage 172*b*. In the present embodiment, the movement mechanism of the carriage 172*b*, including the carriage 172*b* itself, functions as a moving unit of the vacuum wiper 172*c*. Note that this moving unit may include, for example, the movement mechanism of the print head 8.

In the vacuum wiper unit 172, the carriage 172*b* on which the vacuum wiper 172*c* is mounted is slidably provided on a pair of guide rails 172*e* extending in the y-direction. This carriage 172*b* moves back and forth in the y-direction by a motor 32 driven based on the control of the print controller 202. Specifically, the carriage 172*b* moves in the forward direction which is a direction from one end of the opening 172*aa* in the flat plate 172*a* toward the other end and also moves in the backward direction which is a direction from the other end toward the one end. Thus the vacuum wiper 172*c* mounted on the carriage 172*b* is configured to be movable in the forward and backward directions of the y-direction via the carriage 172*b*. In the present embodiment, the vacuum wiping operation is performed only while the vacuum wiper 172*c* is moving in the forward direction (a predetermined direction) via the carriage 172*b*. Note that in the present embodiment, the carriage 172*b* is positioned at the other end of the opening 172*aa* while the case where the carriage 172*b* is not executing vacuum wiping operation.

The motor 32 is connected to a pulley 36 via gears 34. The pulley 36 is located at an end portion of the other end side of the opening 172*aa*, and a belt 40 is provided in a tensioned state between the pulley 36 and an idler pulley 38 located at an end portion of the one side of the opening 172*aa*. Thus the belt 40 rotates driven by the motor 32. The belt 40 is arranged to extend in the y-direction. The carriage 172*b* is fixed to the belt 40. Thus the rotation of the belt 40 moves the carriage 172*b* along the guide rails 172*e*, and the rotation direction of the belt 40 determines the moving direction of the carriage 172*b*. The motor 32 is connected to a rotary encoder 33 capable of detecting the amount of rotation, the rotation direction, and the like of the motor 32. The print controller 202 detects the moving direction, the moving distance, and the like of the carriage 172*b* based on detection results by this rotary encoder 33.

Figure 11A:
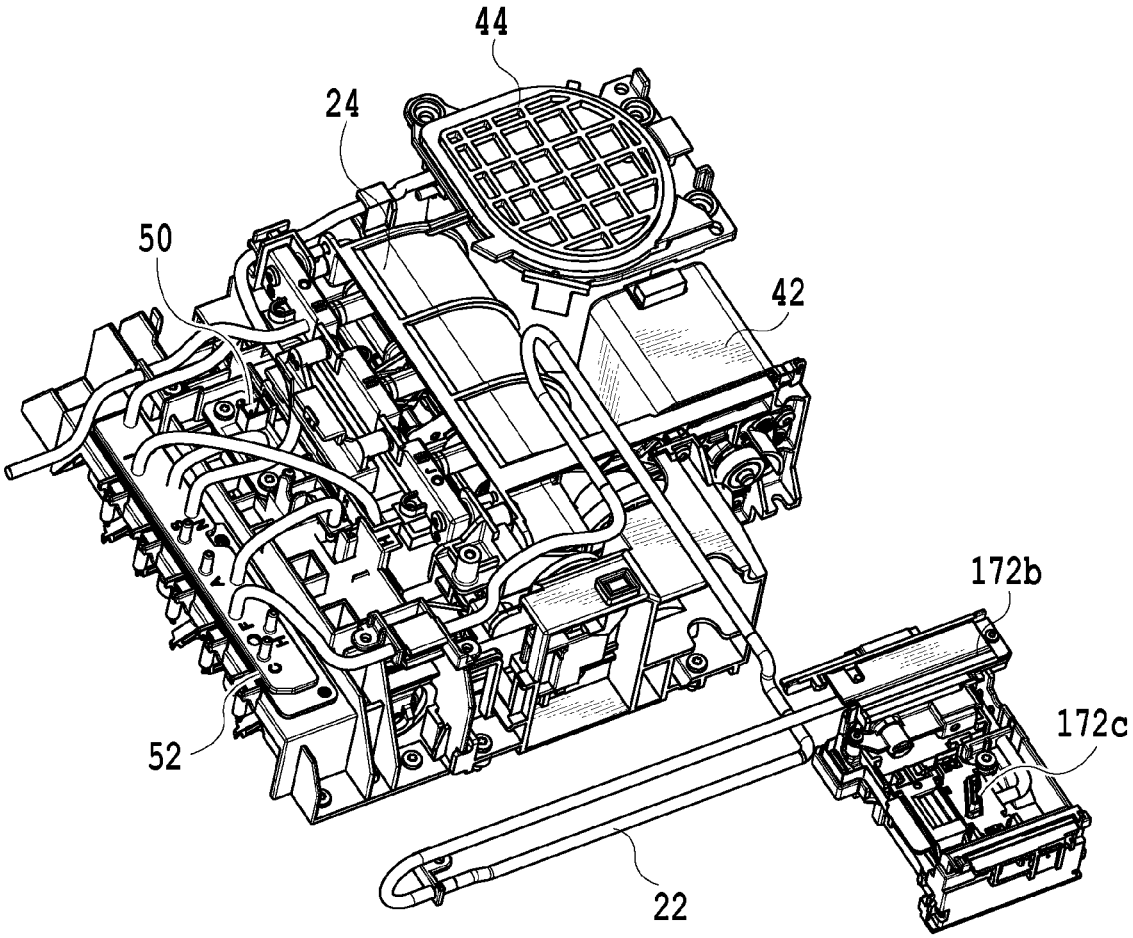
FIGS. 11A and 11B are explanatory diagrams of a suction mechanism for the vacuum wiper.
Figure 11B:
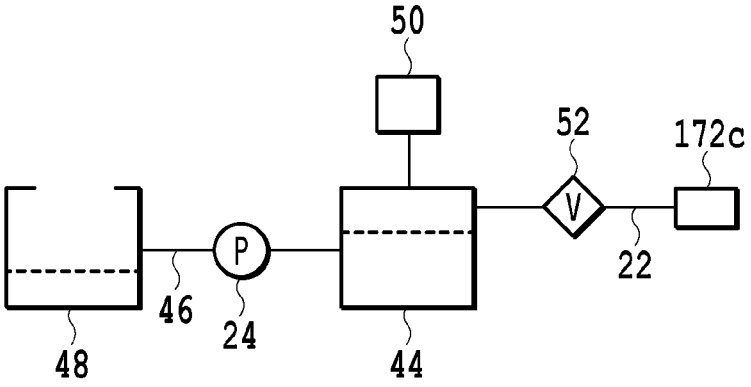

Next a suction mechanism of the vacuum wiper 172*c* will be described with reference to FIGS. 11A and 11B. FIG. 11A is a schematic configuration diagram illustrating the suction mechanism connected via the tube 22 to the vacuum wiper 172*c* mounted on the carriage 172*b*. FIG. 11B is a configuration diagram schematically illustrating the suction mechanism in FIG. 11A.

The vacuum wiper 172*c* mounted on the carriage 172*b* is connected to the suction mechanism including the suction pump 24 via the tube 22. The suction mechanism includes the suction pump 24, a motor 42 that drives the suction pump 24, and a buffer tank 44 (tank) the internal space of which is adapted to be depressurized by the suction pump 24. The suction mechanism also includes a waste ink tank 48 connected to the buffer tank 44 via a flow path 46 and a pressure sensor 50 (pressure detection unit) capable of measuring the pressure inside the buffer tank 44.

The suction pump 24 is provided on the flow path 46 connecting the buffer tank 44 and the waste ink tank 48. The motor 42 which drives the suction pump 24 is controlled by the print controller 202. Under the control of the print controller 202, the motor 42 drives the suction pump 24 to depressurize the buffer tank 44. During the operation, the print controller 202 monitors the pressure inside the buffer tank 44 with the pressure sensor 50, and when the pressure reaches a predetermined pressure, the print controller 202 stops the suction pump 24 via the motor 42.

A valve 52 is provided at a point on the tube 22 which connects the vacuum wiper 172*c* and the buffer tank 44. Thus, in the state where the valve 52 is open, the buffer tank 44 communicates with the vacuum wiper 172*c* via the tube 22, and in the state where the valve 52 is closed, the buffer tank 44 does not communicate with the vacuum wiper 172*c* via the tube 22. Ink, foreign objects, and the like sucked from the vacuum wiper 172*c* by vacuum wiping are collected via the tube 22, the buffer tank 44, and other parts into the waste ink tank 48. Note that the suction pump 24 is also connected to the cap unit 10 (*cap*) via a tube (not illustrated) and thus is capable of sucking ink collected in the cap member 10*a*. Thus, by opening or closing the valve 52, the suction pump 24 performs sucking on one of the vacuum wiper 172*c* and the cap unit 10.

(Vacuum Wiping Process)

Figure 13:
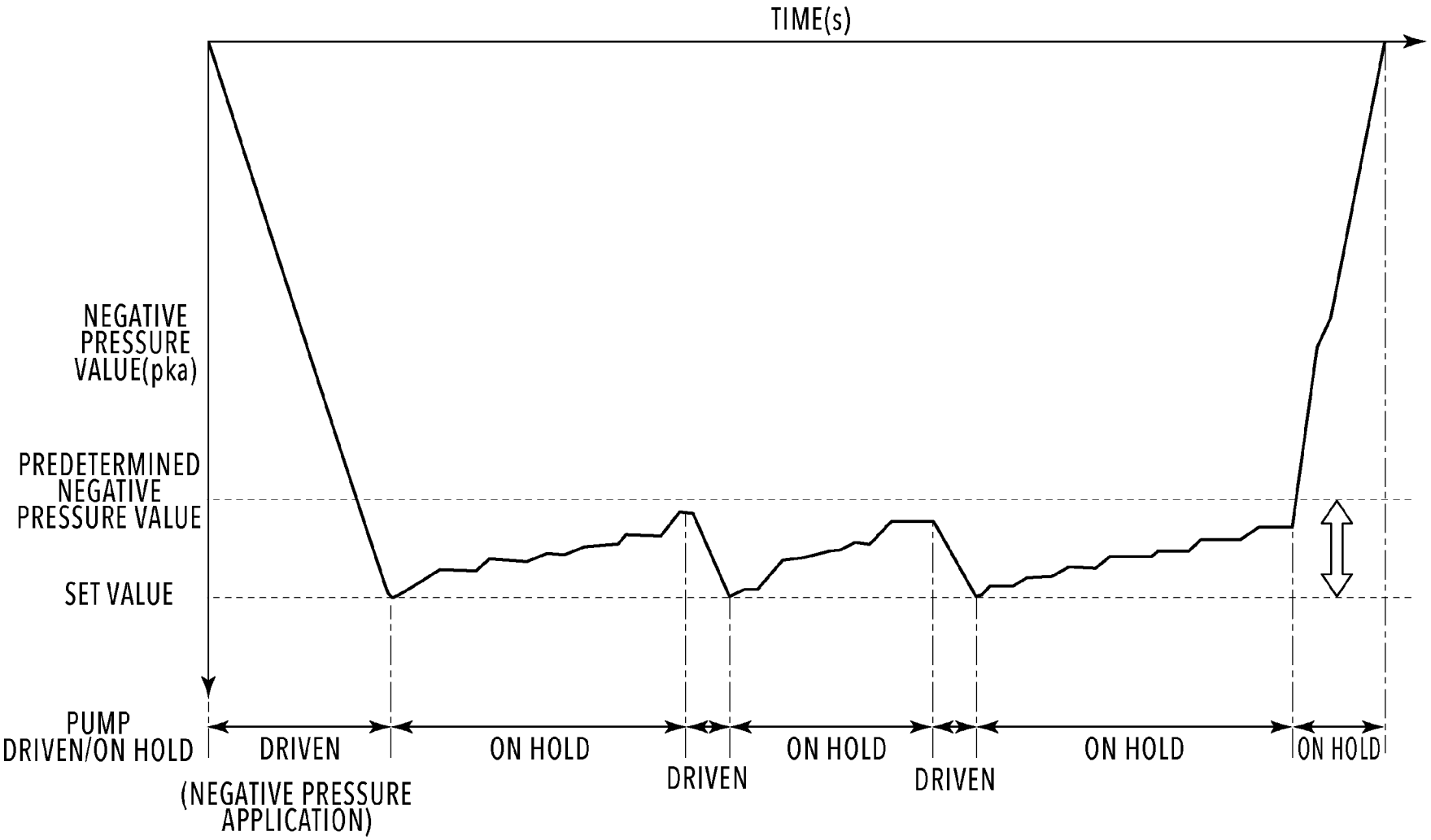
FIG. 13 is a diagram illustrating pressure fluctuation during vacuum wiping.
Figure 14:
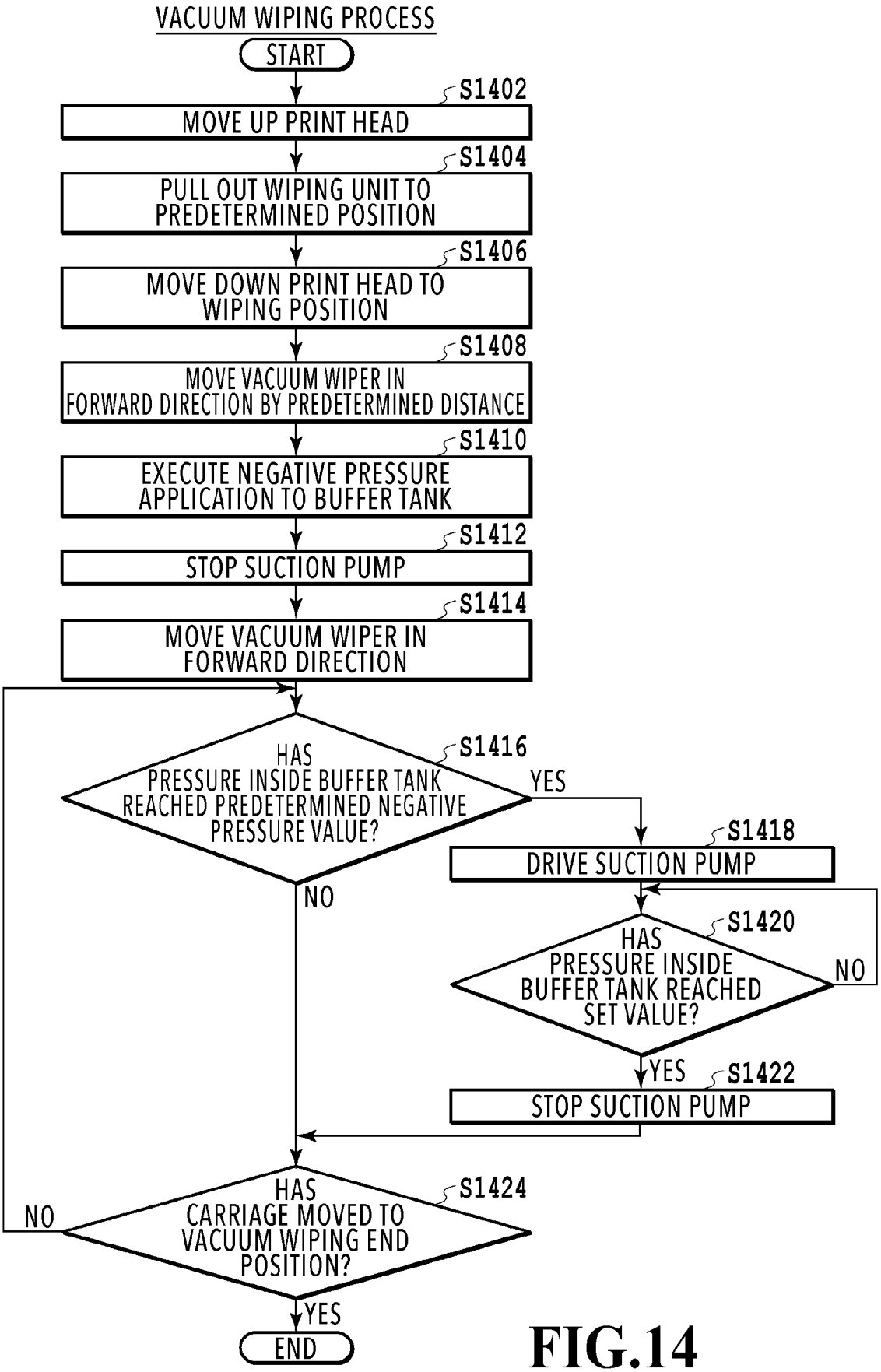
FIG. 14 is a flowchart illustrating detailed process procedure of a vacuum wiping process.

Execution of vacuum wiping using the vacuum wiper unit 172 with the configuration above will be described. FIG. 12A is a diagram illustrating the ejection opening surface 8*a* of the print head 8 brought into contact with the vacuum wiper 172*c* at the start of vacuum wiping. FIG. 12B is a diagram illustrating the suction preparation surface 8*ab*, adapted to come into contact with the vacuum wiper 172*c* at the start of vacuum wiping, and its vicinities on the ejection opening surface 8*a*. FIG. 12C is a diagram illustrating the vacuum wiper 172*c* that has come into contact with the suction preparation surface 8*ab*. FIG. 12D is a diagram illustrating the vacuum wiper 172*c* moved in the forward direction from the state illustrated in FIG. 12C by a predetermined distance. Note that the vacuum wiper 172*c* is simplified in the illustrations of FIGS. 12C and 12D. FIG. 13 is a graph illustrating the fluctuation of the pressure value in the buffer tank during vacuum wiping operation. FIG. 14 is a flowchart illustrating detailed process procedure of a vacuum wiping process in the second wiping process.

In the second wiping process, after a wiping process using the blade wiper unit 171 is performed, a vacuum wiping process is performed in which a vacuum wiping operation using the vacuum wiper unit 172 is executed. In the following description, the vacuum wiping process will be described in detail.

When the vacuum wiping process starts, first the carriage 172*b* is moved to a wiping start position illustrated in FIG. 8B, and the carriage 172*b* is moved in the forward direction until it hits a stopper to find its home position and then moved in the backward direction to the wiping start position. After that, the print head 8 is made to retreat to a position higher in the vertical direction than the wiping position in FIG. 7 (S1402), and the wiping unit 17 is slid and pulled out from the maintenance unit 16 to a predetermined position (S1404). The predetermined position is a position at which the vacuum wiper 172*c* comes into contact with the suction preparation surface 8*ab* in the case where the print head 8 is moved down to the wiping position, and at which the vacuum wiper 172*c* can perform vacuum wiping for the ejection openings of the ejection unit 81 by moving in the forward direction.

After that, the print controller 202 moves down the print head 8 to the wiping position illustrated in FIG. 7 (S1406). In this state, the carriage 172*b* is positioned at the wiping start position which is at the end on the one end side of the opening 172*aa*, and the vacuum wiper 172*c* mounted on the carriage 172*b* is in contact with the suction preparation surface 8*ab* of the ejection opening surface 8*a* (see FIG. 12A). Also at this time, the vacuum wiper 172*c* moves in the arrow-C direction against the urging force of the urging member 30, and the vacuum wiper 172*c* is pressed against the suction preparation surface 8*ab* at a predetermined pressure by the urging force.

Next, the print controller 202 drives the motor 32 to move the vacuum wiper 172*c* via the carriage 172*b* with the vacuum wiper 172*c* in contact with the ejection opening surface 8*a* in the forward direction, in which the vacuum wiper 172*c* moves during vacuum wiping, by a predetermined distance, and then the print controller 202 stops it there (S1408). After that, in the state where the suction pump 24 and the vacuum wiper 172*c* are connected by the valve 52, the motor 42 is driven to make the suction pump 24 perform sucking (negative pressure application) until the pressure inside the buffer tank 44 reaches a set value (S1410). This operation also depressurizes the inside of the vacuum wiper 172*c* communicating with the buffer tank 44. The set value (first value) is set based on a predetermined negative pressure value (second value) set according to the process condition described later. In the present embodiment, the set value is set to a negative pressure value higher than the predetermined negative pressure value.

At this time, when the print head 8 is moved down, the vacuum wiper 172*c* comes into contact with the ejection opening surface 8*a* such that the entire upper end surface 26*b* (top surface) of the elastic member 26 comes into contact with the suction preparation surface 8*ab* as illustrated in FIG. 12C. In this state, the urging force per unit area of the upper end surface 26*b* in contact with the suction preparation surface 8*ab* is low, and accordingly, the contact portions may not conform to minute irregularities at the opening 26*a* of the elastic member 26 or on the suction preparation surface 8*ab*. Consequently, at the negative pressure application to the buffer tank 44, outside air easily enter from between the vacuum wiper 172*c* and the suction preparation surface 8*ab*.

In the present embodiment, before suction by the suction pump 24 is started, the vacuum wiper 172*c* is moved in the forward direction by a predetermined distance with the vacuum wiper 172*c* in contact with the suction preparation surface 8*ab*. This operation makes the edges of the upper end surface 26*b* of the elastic member 26 in contact with the suction preparation surface 8*ab* as illustrated in FIG. 12D. In this state, the contact area between the suction preparation surface 8*ab* and the upper end surface 26*b* is smaller, and accordingly, the urging force per unit area of the upper end surface 26*b* in contact with the suction preparation surface 8*ab* is greater. This enables the contact portions to conform to minute irregularities at the opening 26*a* of the elastic member 26 or on the suction preparation surface 8*ab*, reducing outside air entering from between the vacuum wiper 172*c* and the suction preparation surface 8*ab* at the negative pressure application to the buffer tank 44.

Hence the above predetermined distance is set to a moving distance that changes the state where the entire upper end surface 26*b* of the elastic member 26 is in contact with the suction preparation surface 8*ab* into the state where edges of the upper end surface 26*b* are in contact with the suction preparation surface 8*ab*. Since the predetermined distance varies depending on the shape, material, and other factors of the elastic member 26 of the vacuum wiper 172*c*, the predetermined distance is determined, for example, experimentally.

When the buffer tank 44 is depressurized to the set value by the negative pressure application, the print controller 202 stops the motor 42 to stop the suction of the suction pump 24 (S1412). After that, the print controller 202 moves the vacuum wiper 172*c* via the carriage 172*b* in the forward direction with the vacuum wiper 172*c* in contact with the ejection opening surface 8*a* and performs vacuum wiping for the ejection openings arranged on the ejection opening surface 8*a* of the ejection unit 81 (S1414). Note that the moving speed of the vacuum wiper 172*c* at S1414 is determined based on the moving speed set according to the process condition described later.

Here, on the ejection opening surface 8*a* are provided the ejection unit 81, a frame 82, a sealing portion 83, and a wiring sealing portion 84. The ejection unit 81 is disposed on the sealing portion 83, and thus the wiring connected to the ejection unit 81 is sealed by the wiring sealing portion 84. The sealing portion 83 is recessed relative to the ejection unit 81 and the frame 82. The wiring sealing portion 84 protrudes relative to the ejection unit 81 and the frame 82. Each ejection unit 81 is arranged to be inclined relative to the moving direction of the vacuum wiper 172*c* (the y-direction).

Note that the vacuum wiper 172*c* is pressed against the ejection opening surface 8*a* by the urging member 30. Thus the vacuum wiper 172*c* can conform to the above irregularities on the ejection opening surface 8*a* to some extent. However, multiple ejection units 81 are arrayed in the moving direction, and there are some points where the vacuum wiper 172*c* cannot conform to the ejection opening surface 8*a* due to the moving speed or other factors. Thus outside air flows in from the opening 26*a* of the vacuum wiper 172*c*. In the present embodiment, since the inside of the vacuum wiper 172*c* is depressurized to the set value along with the buffer tank 44, even though outside air flows in from the opening 26*a*, the negative pressure acting on the ejection openings and the like at the opening 26*a* will not suddenly decrease. However, along with the movement of the vacuum wiper 172*c*, the pressure inside the vacuum wiper 172*c* and the buffer tank 44 gradually increases.

To address this situation, it is determined in the present embodiment whether the pressure inside the buffer tank 44 has reached the predetermined negative pressure value during the movement of the vacuum wiper 172*c* in the forward direction (S1416). Specifically, at S1416, it is determined whether the pressure inside the buffer tank 44 has decreased to the predetermined negative pressure value along with the movement of the vacuum wiper 172*c*. As described above, the predetermined negative pressure value is a pressure higher than the set value at the negative pressure application to the buffer tank 44 (the negative pressure value is smaller). Note that the predetermined negative pressure value is set according to the process condition described later.

If the print controller 202 determines at S1416 that the pressure inside the buffer tank 44 detected by the pressure sensor 50 has reached the predetermined negative pressure value, the print controller 202 drives the motor 42 to resume suction of the suction pump 24 (S1418). Note that also during the process at S1418, the vacuum wiper 172*c* is moving in the forward direction. After that, it is determined whether the pressure inside the buffer tank 44 has reached the set value (S1420). If it is determined that it has reached the set value, the suction pump 24 is stopped (S1422), and the process proceeds to S1424 described later. Note that the determination at S1416 is made by the print controller 202 based on the detection results by the pressure sensor 50. In summary, in the present embodiment, control is performed to drive or stop the suction pump 24 during the vacuum wiping (during the suction wiping operation) so that the pressure inside the buffer tank 44 is controlled to be kept within the predetermined range (between the predetermined negative pressure value and the set value) (see FIG. 13).

On the other hand, if it is determined at S1416 that the pressure inside the buffer tank 44 has not reached the predetermined negative pressure value, it is determined whether the carriage 172*b* has moved to a vacuum wiping end position set in advance (S1424). The determination at S1424 is made by the print controller 202 based on the detection results by the rotary encoder 33.

If it is determined at S1424 that the carriage 172*b* has not moved to the vacuum wiping end position, the process returns to S1416. On the other hand, if it is determined at S1424 that the carriage 172*b* has moved to the vacuum wiping end position, this vacuum wiping process ends.

In the case where the vacuum wiping process ends as above, the print controller 202 makes the print head 8 retreat upward in the vertical direction.

(Execution Management of Vacuum Wiping)

In the present embodiment, the negative pressure value and the operation time (the moving speed) during vacuum wiping are made different depending on the purposes of removal, in other words, depending on objects to be removed by the vacuum wiping. There are three cases regarding the purposes of removal, shown below. A first case is one where foreign objects attached in the vicinities of the ejection openings or pushed into the ejection openings are to be removed (hereinafter referred to as "removal of foreign objects" as appropriate), and in this case, the objects to be removed are foreign objects. Another case is one where ink thickened in the ejection openings is to be removed (hereinafter "removal of thickened ink" as appropriate), and in this case, the object to be removed is thickened ink. Still another case is one where bubbles that have occurred in the ejection openings are to be removed (hereinafter referred to as "removal of bubbles" as appropriate), and in this case, the objects to be removed are bubbles. The timing at which the vacuum wiping process is to be performed and the process condition for the vacuum wiping process are set according to each purpose of removal, in other words, the objects to be removed by the vacuum wiping.

Specifically, for removal of thickened ink, ink thickened in the vicinities of the ejection openings within the ejection openings is to be removed. In other words, since in this case, only thickened ink needs to be pulled out from the ejection openings, ejecting condition can be recovered by only applying a low negative pressure for a short time period. For this reason, the process condition for removal of thickened ink (hereinafter referred to as the "first condition") is set as follows: the negative pressure value, small; the moving speed, high (high-speed). Note that the negative pressure value and the moving speed in the first condition and a second condition and third condition described later show relative magnitude relationship between the process conditions for the three removal purposes.

In the case where an irregular termination occurs in which print operation ends without being able to cap the ejection opening surface 8*a* with the cap unit 10, and the ejection opening surface 8*a* is left unprotected (uncovered) with the cap unit 10 for a first time period or more, ink thickening occurs in the ejection openings. In the present embodiment, in the case where the time after an irregular termination occurs with the cap open until an irregular solving process is executed and print operation is ready to start again is less than the first time period, vacuum wiping is executed based on the first condition. The first time period (first threshold) can be set to, for example, a predetermined time period longer than or equal to five minutes and shorter than six hours. Note that in the case where the first time period is six hours or longer, for example, suction is performed using the cap unit 10. Suction using the cap unit 10 is more powerful than vacuum wiping and is accordingly capable of removing more thickened ink.

For removal of bubbles, in order to pull bubbles that have occurred in flow paths of the ejection openings out of the ejection openings, a relatively high negative pressure needs to be applied for a long time. For this reason, the process condition for removal of bubbles (hereinafter referred to as the "second condition") is set as follows: the negative pressure value, middle; the moving speed, low (low-speed).

Bubbles that have occurred in ink grow over time. Hence, in the case where it is determined that a second time period has passed since the last-executed vacuum wiping, vacuum wiping is executed based on the second condition. The second time period (second threshold) varies depending on used ink, the configuration of the print head 8, and other factors and thus is determined experimentally. For example, in the case where it is determined that the ejection opening surface 8*a* has been capped with the cap unit 10 for 30 days (720 hours) or more, vacuum wiping is executed based on the second condition.

For removal of foreign objects, in order to remove foreign objects such as paper dust attached in the vicinities of the ejection openings or pushed into the ejection openings, high negative pressure is necessary also to pull the foreign objects out of the ejection openings. Note that because foreign objects are often positioned in the vicinities of the ejection openings and hence are easier to be pulled out than bubbles that have occurred in the flow paths of the ejection openings, the operation time can be relatively short. For this reason, the process condition for removal of foreign objects (hereinafter referred to as the "third condition") is set as follows: the negative pressure value, large; the moving speed, middle (middle-speed).

The amount of attached foreign objects such as paper dust increases as the number of conveyed print media increases. For this reason, in the case where it is determined that the number of conveyed print media has reached a predetermined number, vacuum wiping is executed based on the third condition. The predetermined number is set to, for example, 5000. However, the predetermined number may be set as appropriate according to the type of print media to be used, the configuration of the conveying path of the printing apparatus, and other factors.

Figure 15:
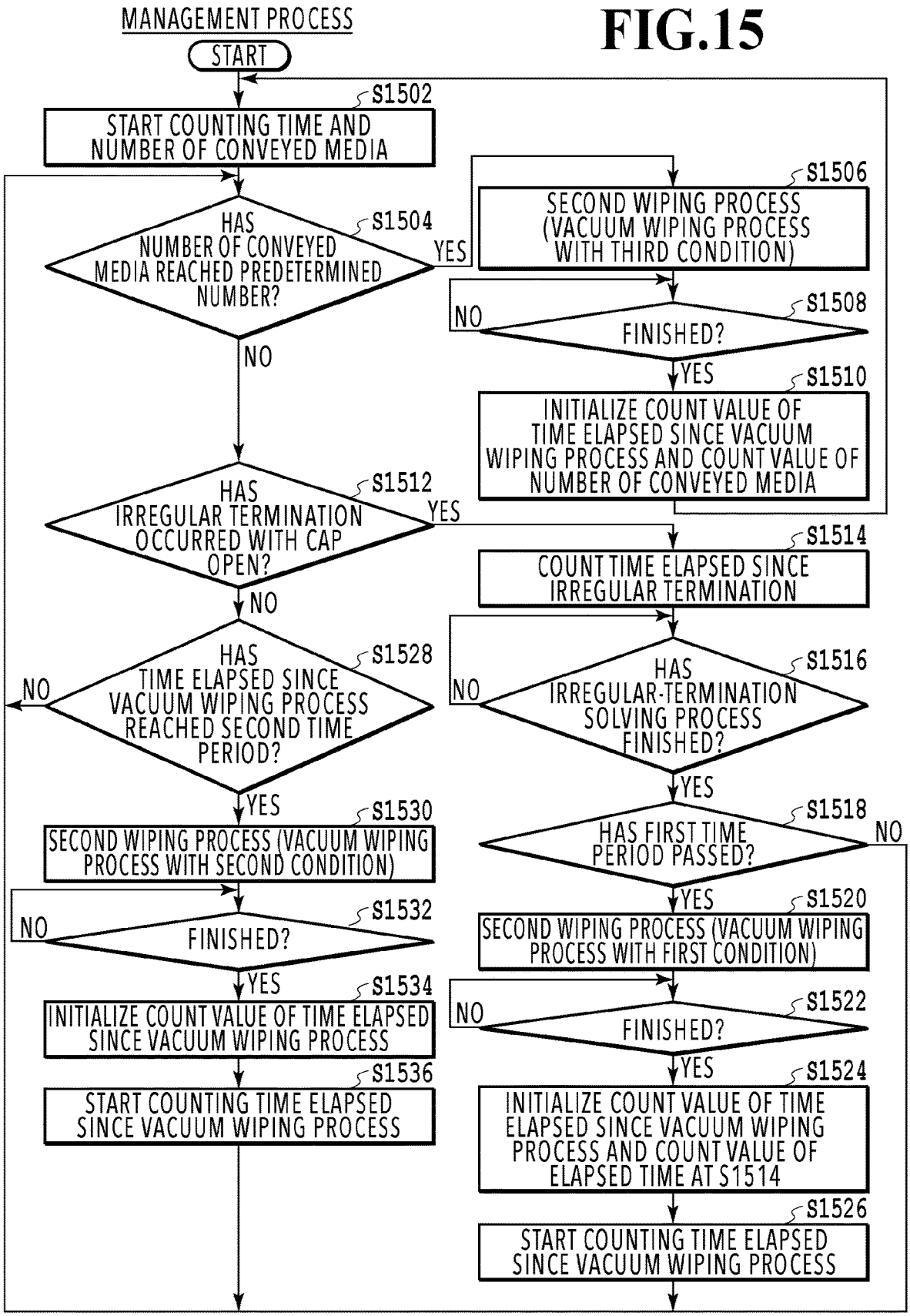
FIG. 15 is a flowchart illustrating detailed process procedure of a management process.

In the present embodiment, when a first print operation is performed in the printing apparatus 1, a management process starts for managing execution of vacuum wiping (the second wiping process). Note that this management process is executed in parallel with various processes such as printing process for performing printing on print media, for example. FIG. 15 is a flowchart illustrating detailed process procedure of the management process.

When the management process starts, first the print controller 202 starts counting time with the counter 211, and also the print controller 202 starts counting the number of conveyed print media based on the detection results by the sensor 212 (S1502). Note that a first count value counted by the counter 211 at S1502 is initialized after the vacuum wiping process is executed, as described later. Hence the first count value indicates the time elapsed since the last (latest) vacuum wiping process.

Next it is determined whether the number of conveyed media has reached the predetermined number (for example, 5000) (S1504). The process at this S1504 is a process for determining whether to execute removal of foreign objects by vacuum wiping. At S1504, the print controller 202 determines whether a second count value counted based on the detection results by the sensor 212 (the count value of the number of conveyed media) has reached, for example, "5000".

If it is determined at S1504 that the number of conveyed media has reached the predetermined number, in other words, that removal of foreign objects should be executed, the second wiping process is executed (S1506). In this case, the vacuum wiping process is executed in the above third condition. Specifically, in the case where it is determined that the removal of foreign objects should be executed by vacuum wiping, the value of the negative pressure applied to the ejection opening surface 8*a* and the moving speed of the vacuum wiper 172*c* are determined according to the third condition set in advance. Note that in the case where print operation is being performed based on a predetermined job when it is determined that the number of conveyed media has reached the predetermined number, the print operation may be stopped to execute the second wiping process, or the second wiping process may be executed after the print operation according to the job finishes.

Specifically, in the third condition, for example, the predetermined negative pressure value is set to −50 kPa; the moving speed is set to 7 mm/s. The set value is set to, for example, −60 kPa. Thus, in the vacuum wiping process in the second wiping process executed at S1506, the negative pressure application is performed at S1410 such that the pressure inside the buffer tank 44 becomes −60 kPa. At S1414, the vacuum wiper 172*c* is moved in the forward direction at 7 mm/s. At S1416, it is determined whether the pressure inside the buffer tank 44 has reached −50 kPa. At S1420, it is determined whether the pressure inside the buffer tank has reached −60 kPa.

After that, it is determined whether the second wiping process has finished (S1508), and if it is determined that it has finished, the first and second count values are initialized (S1510), and the process proceeds to S1502.

Then, if it is determined at S1504 that the number of conveyed media has not reached the predetermined number, in other words, that removal of foreign objects should not be executed, it is determined whether an irregular termination has occurred in which operation ends without being able to cap the ejection opening surface 8*a* with the cap unit 10 (S1512). This S1512 and S1518 described later are processes for determining whether to execute removal of thickened ink by vacuum wiping. Note that the determination process at S1512 is executed by the print controller 202 based on the detection results by various sensors provided in the printing apparatus 1.

If it is determined at S1512 that an irregular termination has occurred with the cap open, the counter 211 starts counting the time elapsed since the irregular termination (S1514). Next it is determined whether an irregular termination solving process has finished (S1516). Note that the determination whether the irregular termination solving process has finished is made by the print controller 202, for example, based on the detection results by various sensors provided in the apparatus, an input from the user, or other information.

If it is determined at S1516 that the irregular termination solving process has finished, it is determined whether a third count value indicating the time elapsed since the irregular termination has reached the first time period (S1518). Note that the first time period is a time period as a criterion for vacuum wiping for the purpose of removal of thickened ink and is set, for example, to a predetermined time period of five minutes or longer and shorter than six hours. If it is determined at S1518 that the third count value has not reached the first time period, the process returns to S1504.

If it is determined at S1518 that the third count value has reached the first time period, in other words, that removal of thickened ink should be executed, the second wiping process is executed (S1520). In this case, the vacuum wiping process is executed in the above first condition. In other words, if it is determined that removal of thickened ink should be executed by vacuum wiping, the value of the negative pressure applied to the ejection opening surface 8*a* and the moving speed of the vacuum wiper 172*c* are determined according to the first condition set in advance.

Specifically, in the first condition, for example, the predetermined negative pressure value is set to −10 kPa; the moving speed is set to 10 mm/s. The set value is set to, for example, −15 kPa. Thus, in the vacuum wiping process in the second wiping process executed at S1520, the negative pressure application is performed at S1410 such that the pressure inside the buffer tank 44 becomes −15 kPa. At S1414, the vacuum wiper 172*c* is moved in the forward direction at 10 mm/s. At S1416, it is determined whether the pressure inside the buffer tank 44 has reached −10 kPa. At S1420, it is determined whether the pressure inside the buffer tank has reached −15 kPa.

After that, it is determined whether the second wiping process has finished (S1522), and if it is determined that it has finished, the first and third count values are initialized (S1524). Then the counter 211 starts counting the time elapsed since the vacuum wiping process (S1526), and the process returns to S1504.

On the other hand, if it is determined at S1512 that an irregular termination has not occurred, in other words, that removal of thickened ink should not be executed, it is determined whether the first count value indicating the time elapsed since the last vacuum wiping process has reached the second time period (S1528). This S1528 is a determination process executed by the print controller 202, which is a process performed for determining whether to execute removal of bubbles by vacuum wiping. The second time period is a time period as a criterion for vacuum wiping for the purpose of removal of bubbles and is set, for example, to 720 hours. If it is determined at S1528 that the first count value has not reached the second time period, in other words, that removal of bubble ink should not be executed, the process returns to S1504.

If it is determined at S1528 that the first count value has reached the second time period, in other words, that removal of bubble ink should be executed, the second wiping process is executed (S1530). In this case, the vacuum wiping process is executed in the above second condition. In other words, if it is determined that removal of bubbles should be executed by vacuum wiping, the value of the negative pressure applied to the ejection opening surface 8*a* and the moving speed of the vacuum wiper 172*c* are determined according to the second condition set in advance.

Specifically, in the second condition, for example, the predetermined negative pressure value is set to −20 kPa; the moving speed is set to 5 mm/s. The set value is set to, for example, −28 kPa. Thus, in the vacuum wiping process in the second wiping process executed at S1530, the negative pressure application is performed at S1410 such that the pressure inside the buffer tank 44 becomes −28 kPa. At S1414, the vacuum wiper 172*c* is moved in the forward direction at 5 mm/s. At S1416, it is determined whether the pressure inside the buffer tank 44 has reached −20 kPa. At S1420, it is determined whether the pressure inside the buffer tank has reached −28 kPa.

After that, it is determined whether the second wiping process has finished (S1532), and if it is determined that it has finished, the first count value is initialized (S1534). Then, the counter 211 starts counting the time elapsed since the vacuum wiping process (S1536), and the process returns to S1504.

As has been described, the print controller 202 controls the movement and suction of the vacuum wiper 172*c* in the present embodiment. In addition, the print controller 202 determines the timing for executing vacuum wiping and also determines the process condition in the vacuum wiping based on the determination results. In other words, in the present embodiment, the print controller 202 functions as a control unit that performs various kinds of control on the vacuum wiping operation such as controlling the movement and suction of the vacuum wiper 172*c*, determining the timing for vacuum wiping, and determining the process condition.

As has been described above, in the printing apparatus 1, the vacuum wiping process is executed at the timing according to the purpose of removal in the process condition according to the purpose of removal. This enables the printing apparatus 1 to execute efficient vacuum wiping processes according to the purposes of removal. This also reduces the amount of waste ink. Accordingly, the waste ink tank 48 can be downsized, contributing to downsizing of the printing apparatus 1.

In addition, the printing apparatus 1 has the buffer tank 44 communicating with the vacuum wiper 172*c*, and the suction pump 24 is driven based on the pressure value inside the buffer tank 44. Because of the buffer tank 44, even though outside air flows in from the opening 26*a* of the vacuum wiper 172*c*, the negative pressure acting on the ejection opening surface 8*a* does not suddenly decrease, thus providing a stable effect of vacuum wiping.

Further, in the printing apparatus 1, when the buffer tank 44 is depressurized to the set value by the negative pressure application to the buffer tank 44, the suction pump 24 is stopped. After that, the vacuum wiper 172*c* is moved in the forward direction. When the pressure inside the buffer tank 44 increases to the predetermined negative pressure value, the suction pump 24 is driven to depressurize the inside of the buffer tank 44 to the set value while the vacuum wiper 172*c* is moving in the forward direction. This operation prevents the suction force of vacuum wiping from differing largely between the start and end of vacuum wiping. This operation also reduces the driving time of the suction pump 24, which in turn reduces the power consumption, making the execution of the vacuum wiping operation efficient.

In addition, in the printing apparatus 1, after the vacuum wiper 172*c* and the suction preparation surface 8*ab* of the ejection opening surface 8*a* are brought into contact with each other, the vacuum wiper 172*c* is moved in the forward direction by a predetermined distance. This operation ensures the close contact between the upper end surface 26*b* of the vacuum wiper 172*c* and the suction preparation surface 8*ab*, and thus making the execution of the negative pressure application to the buffer tank 44 efficient.

Other Embodiments

Note that the above embodiment may be modified as shown in the following (1) to (4).

(1) Although in the present embodiment, the vacuum wiping process is performed for the three purposes of removal, in respective different process conditions, the present disclosure is not limited to this operation. Specifically, the vacuum wiping process may be performed for two or four or more purposes of removal, in respective different process conditions.

(2) In the above embodiment, the vacuum wiper 172*c* is moved relative to the ejection opening surface 8*a* in vacuum wiping. In addition, the vacuum wiper 172*c* is brought into contact with the ejection opening surface 8*a* by pulling the wiping unit 17 out of the maintenance unit 16 and moving the print head 8 to the wiping position. However, the relationship between the movements of the print head 8 and the vacuum wiper 172*c* is not limited to these operations. In other words, any configuration is possible as long as the print head 8 and the vacuum wiper 172*c* can move relative to each other.

(3) Although in the above embodiment, printing is performed on print media conveyed by the printing apparatus 1, the present disclosure is not limited to this configuration. Specifically, a configuration may be such that the printing apparatus 1 performs printing by ejecting ink from the print head onto print media placed at a predetermined position. Although in the above embodiment, vacuum wiping is performed only while the vacuum wiper 172*c* moves in the forward direction, the present disclosure is not limited to this operation. Specifically, vacuum wiping may be performed only while the vacuum wiper 172*c* moves in the backward direction, or while it moves both in the forward direction and in the backward direction.

(4) Although in the above embodiment, the timing for executing vacuum wiping is determined in the management process based on the conditions set according to objects to be removed by the vacuum wiping, the present disclosure is not limited to this operation. Specifically, a detection unit may be provided which is capable of detecting the state of the print head 8, for example, whether ink thickening has occurred, whether foreign objects have been attached to or pushed into the ejection openings, or whether bubbles have occurred, and the timing for executing vacuum wiping may be determined based on the detection results by the detection unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-189626 filed Oct. 5, 2018, which is hereby incorporated by reference wherein in its entirety.

What is claimed is:

1. A printing apparatus comprising:

a printing unit having an ejection opening surface on which multiple ejection openings configured to eject liquid are arrayed;

a wiping unit capable of wiping the ejection opening surface by moving in a predetermined direction relative to the ejection opening surface;

a suction unit connected to the wiping unit and configured to apply negative pressure to the ejection opening surface;

a moving unit configured to move the wiping unit in the predetermined direction relative to the ejection opening surface;

a control unit configured to perform suction wiping operation by wiping the ejection opening surface with the wiping unit while driving the suction unit to apply negative pressure to the ejection opening surface, and a conveying unit configured to convey print media, wherein the control unit determines a moving speed of the wiping unit by the moving unit or a negative pressure value applied by the suction unit, wherein the control unit determines a moving speed of the wiping unit or a negative pressure value applied by the suction unit according to timing at which to perform the suction wiping operation, wherein the timing includes a first timing at which the number of print media that have been conveyed by the conveying unit exceeds a predetermined number.

2. The printing apparatus according to claim 1, wherein the timing is based on an object to be removed by the suction wiping operation.

3. The printing apparatus according to claim 1, further comprising a tank disposed between the wiping unit and the suction unit and configured to be depressurized by the suction unit.

4. The printing apparatus according to claim 3, further comprising a pressure detection unit configured to detect a pressure value of the pressure inside the tank.

5. The printing apparatus according to claim 4, wherein before starting the suction wiping operation, the control unit drives the suction unit until a pressure value detected by the pressure detection unit reaches a first negative value pressure with the wiping unit in contact with a suction preparation surface that is part of the ejection opening surface and on which the ejection openings are not arrayed.

6. The printing apparatus according to claim 5, wherein the control unit starts the suction wiping operation by moving the wiping unit in the predetermined direction at the moving speed determined, and in a case where the pressure value detected by the pressure detection unit reaches a second negative value pressure weaker than the first negative pressure during the movement of the wiping unit in the predetermined direction, the control unit drives the suction unit until the pressure value reaches the first negative pressure value.

7. The printing apparatus according to claim 5, wherein the control unit brings the wiping unit into contact with the suction preparation surface, moves the wiping unit in the predetermined direction by a predetermined distance, and then drives the suction unit until the pressure value detected by the pressure detection unit reaches the first negative pressure value.

8. The printing apparatus according to claim 1, wherein the control unit determines a moving speed of the wiping unit and a negative pressure value applied by the suction unit.

9. A recovery method used in a printing apparatus including a printing unit having an ejection opening surface on which multiple ejection openings configured to eject liquid are arrayed and a wiping unit for wiping the ejection opening surface, the recovery method being for recovering ejection performance of the ejection openings by performing suction wiping operation in which the wiping unit is being moved relative to the ejection opening surface in a state where a suction unit is driven to apply negative pressure to the ejection opening surface, comprising determining a moving speed of the wiping unit or a negative pressure value applied by the suction unit, wherein a moving speed of the wiping unit or a negative pressure value applied by the suction unit is determined in accordance with timing to perform the suction wiping operation, wherein the timing includes a first timing at which the number of print media that have been conveyed by a conveying unit configured to convey print media exceeds a predetermined number.

10. The recovery method according to claim 9, wherein a moving speed of the wiping unit and a negative pressure value applied by the suction unit are determined.

* * * * *